US007099609B2

(12) United States Patent
Hirobe et al.

(10) Patent No.: US 7,099,609 B2
(45) Date of Patent: Aug. 29, 2006

(54) DEVELOPING DEVICE

(75) Inventors: Fumitake Hirobe, Ushiku (JP); Masaru Hibino, Ushiku (JP); Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/171,541

(22) Filed: Jul. 1, 2005

(65) Prior Publication Data

US 2005/0244195 A1 Nov. 3, 2005

Related U.S. Application Data

(62) Division of application No. 10/420,838, filed on Apr. 23, 2003, now Pat. No. 6,973,281.

(30) Foreign Application Priority Data

Apr. 26, 2002 (JP) ..... 2002-127479
Apr. 26, 2002 (JP) ..... 2002-127538

(51) Int. Cl.
*G03G 15/08* (2006.01)
*G03G 15/09* (2006.01)

(52) U.S. Cl. ..... 399/269

(58) Field of Classification Search ..... None
See application file for complete search history.

(56) References Cited

U.S. PATENT DOCUMENTS 4,657,374 A * 4/1987 Kuramoto et al. ..... 399/270
5,438,394 A 8/1995 Suzuki et al. ..... 355/251
5,459,559 A 10/1995 Nagase et al. ..... 355/251
5,576,812 A 11/1996 Hibino et al. ..... 355/251
5,870,656 A 2/1999 Hibino et al. ..... 399/149
5,911,098 A 6/1999 Gyotoku et al. ..... 399/264
5,923,933 A 7/1999 Anzai et al. ..... 399/269
5,991,583 A * 11/1999 Nozawa ..... 399/254
6,049,687 A 4/2000 Hibino et al. ..... 399/270
6,067,433 A 5/2000 Kimura et al. ..... 399/274
6,104,892 A 8/2000 Kobayashi et al. ..... 399/63
6,219,514 B1 4/2001 Kobayashi et al. ..... 399/277
6,269,235 B1 7/2001 Nishiyama ..... 399/267
6,389,245 B1 5/2002 Shida et al. ..... 399/58

(Continued)

FOREIGN PATENT DOCUMENTS

JP 55-32060 3/1980

(Continued)

*Primary Examiner*—Quana Grainger
(74) *Attorney, Agent, or Firm*—Fitzpatrick, Cella, Harper & Scinto

(57) ABSTRACT

A developing apparatus includes a developing container for containing a developer comprising toner and a carrier, said developing container is partitioned into a first chamber and a second chamber constituting a circulation path of the developer; a first developing rotatable member, provided in said first chamber, for developing an electrostatic image formed on the image bearing member with the developer in said first chamber; a regulating member for regulating a layer thickness of the developer on said first developing rotatable member; first magnetic pole and second magnetic pole, disposed in said first developing rotatable member in order named in a rotational direction of said first developing rotatable member, said first magnetic pole and second magnetic pole being defective to form a repelling magnetic field; a second developing rotatable member, disposed in said second chamber, for developing the the electrostatic image formed on the image bearing member with the developer magnetically received from said first developing rotatable member; wherein said regulating member is disposed at a position substantially opposed to said second magnetic pole.

13 Claims, 15 Drawing Sheets

U.S. PATENT DOCUMENTS

| | | | | |
|---|---|---|---|---|
| 6,473,584 | B1 | 10/2002 | Hibino et al. | 399/254 |
| 6,539,192 | B1 | 3/2003 | Hibino | 399/267 |
| 6,546,222 | B1 | 4/2003 | Sakemi et al. | 399/276 |
| 2002/0127488 | A1 | 9/2002 | Suzuki et al. | 430/124 |
| 2003/0185600 | A1 | 10/2003 | Mabuchi et al. | 399/269 |

FOREIGN PATENT DOCUMENTS

| | | |
|---|---|---|
| JP | 5-333691 | 12/1993 |
| JP | 11-194617 | 7/1999 |
| JP | 2000-98716 | 4/2000 |

* cited by examiner

DEVELOPING DEVICE

CROSS-REFERENCE TO RELATED APPLICATION

This application is a divisional of application Ser. No. 10/420,838, filed Apr. 23, 2003, now U.S. Pat. No. 6,973, 281.

FIELD OF THE INVENTION AND RELATED ART

The present invention relates to a developing device usable with a copying machine, a printer, facsimile machine or the like of an electrophotographic type or electrostatic recording type.

In an image forming apparatus such as a copying machine or the like using an electrophotographic type process, an electrostatic latent image formed on an image bearing member such as a photosensitive drum is visualized by depositing a developer. Among conventional developing devices for such a developing operations, there is a type using a two component developer comprising toner particles and carrier particles. Referring first to FIG. 12, there is shown such a developing device. In a developing device 102 using the two component developer, as shown in FIG. 12, the two component developer T is fed while being stirred. In many of the developing devices, two feeding screws 5, namely, a first feeding screw 5 and a second feeding screw 6 which are circulating means for circulating the toner and carrier in the developing container, are juxtaposed and extended in the horizontal direction.

Of these two circulating means 5, 6, the first feeding screw 5 which is closer to the photosensitive drum 10 functions to supply the developer to a developer carrying member (developing sleeve) 8, and also functions to collect the developer after the developer passed through a developing zone. The second feeding screw 6 functions to mix and stir the developer collected from the developing sleeve 8 and a fresh developer. On the other hand, it is a recent demand to save the space in the image forming apparatus of an electrophotographic type, such as a copying machine, printer or the like, and therefore, downsizing of them is desired. Particularly, in the case of a full-color type image forming apparatus, there are provided a plurality of developing devices, and the demand for the downsizing is strong.

In order to accomplish the downsizing, as shown in FIG. 13, a developing device has been proposed in Japanese Laid-open Patent Application Hei 5-333691, for example. The developing device 103 shown in FIG. 13 is such that two screws, namely, feeding screws 5, 6 which are developer circulating means, are arranged vertically. More particularly, the developing device 103 comprises a developing container 2 accommodating the developer and a developing sleeve 8 (developer carrying member) disposed in an opening of the developing container 2 which is faced to the photosensitive drum 10. At the side of the developing container 2 opposite t opening, a developer chamber 3 and a stirring chamber 4 which are defined by the partition 7 are vertically arranged. In the developer chamber 3 and t stirring chamber 4, first and second feeding screws 5, 6 are disposed respectively as circulating means for circulating the developer in the developer container, and for stirring and feeding the developer. The first feeding screw 5 functions to feed the developer in the developer chamber 3, and t second feeding screw 6 functions to feed the toner supplied to the upstream side of the second feeding screw 5 and the developer already existing in the stirring chamber 4 while stirring them, thus uniforming the toner content in the developer.

In the developing device 103 shown in FIG. 13, the developer chamber 3 and t stirring chamber 4 are arranged vertically (vertical arrangement type), and therefore, there is an advantage that space required in a horizontal plane is small. The downsizing is possible in a so-called tandem type or the like color image forming apparatus wherein the plurality of developing devices are arranged horizontally.

The vertical arrangement type has the following advantage.

The developer is supplied from the developer chamber 3 in the direction indicated by arrow an and is taken up on a developing sleeve 8 by the magnetic force generated by the magnetic pole N1 of the magnet roller 8' disposed in the developing container 2 (magnetic field generating means which is stationarily positioned in the developing sleeve 8. With the rotation of the developing sleeve 8, the developer is carried on the developing sleeve 8 and passes by the magnetic pole S1 toward the position of the magnetic pole N2 where the developing sleeve 8 is exposed to the photosensitive drum 10. Then, the developer is further carried on the developing sleeve 8 to the developing zone where there is provided a developing magnetic pole S2 opposed to the photosensitive drum 10. During the developer being carried on the sleeve, the thickness of the thin layer of the developer is magnetically regulated by cooperation of the developer regulating blade 9 (developer regulating member) and a magnetic pole S1 disposed opposed thereto. The thin layer of the developer is used to develop the electrostatic latent image in the developing zone.

Thereafter, the developer remaining on the developing sleeve 8 without being consumed in the developing zone is returned into the developing container 2 by the magnetic pole N3 at the downstream of the developing zone with respect to the rotational direction of the developing sleeve 8. The developer thus returned is removed from the developing sleeve 8 by a repelling magnetic field generated by magnetic poles N1, N3 having the same quality and disposed adjacent to each other, and is collected into a stirring chamber 4 which is a lower half of the developing container 2.

At this time, with rotation of the developing sleeve 8, the developer is not collected into the developer chamber 3 as with the case of horizontal stirring type developing device 102 but is collected into the stirring chamber 4 which is disposed vertically below the developer chamber 3 as indicated by an arrow b. Because of this structure, the developer chamber 3 always contains only the developer that has been sufficiently stirred in the stirring chamber 4. Therefore, the developing sleeve 8 is always supplied with the developer with uniform toner content, thus avoiding non-uniformity in the axial direction to accomplish formation of uniform density images.

SUMMARY OF THE INVENTION

However, the conventional vertical arrangement type developing device 103 involves a problem.

In the developing device 103, the developer layer thickness is regulated using the developer regulating blade 9. The developer regulating blade 9 in this example is provided at the opening of the developing container 2. Adjacent the developer regulating blade 9 in the developing container 2, the developer scraped off the developing sleeve by the blade 9 tends to stagnate. At the inner side of the blade 9, the developer is attracted by the magnetic force generated by the S1 pole opposed to the blade 9 and the N1 pole these posed upstream thereof with respect to the rotational direction of the developing sleeve 8, and therefore, a large amount of the scraped developer stagnates there. In addition, the developer is continuously supplied to this position from the developer chamber 3 on the developing sleeve 8. For these reasons, the large amount of the developer stagnating here is subjected to a large pressure so that magnetic carrier and the toner in the developer are compressed, with the possible result the fine particles of oxide titanium or the like externally added are planted into the toner particles.

In addition, by the friction between the toner and the magnetic carrier particles, the particle shape of the toner per se is rounded. With long-term use, the toner may be deposited and adhered on the magnetic carrier particles (a so-called spent phenomenon).

When such deterioration of the developer occurs, the triboelectric charge amount of the toner varies with elapses of time with the result of variation in the development property of the toner which leads to non-uniformity of the image density or increase of the mechanical deposition power of the toner relative to the magnetic carrier particles or to the photosensitive drum. Then, the developing action and image transfer action do not corresponding to the electric field. This may result in local defects of the toner, and therefore, the image quality is deteriorating.

The inventors' investigations have revealed that degree of deterioration of the developer is significantly related with a development driving torque. For example, it has been confirmed that only by removing the developer regulating member out of a conventional developing device, the development driving torque lowers to approx. 1/10 and that developer is not deteriorated at all by idle rotation. By repeating the experiments, the development driving torque increase is mainly caused by the amount of the developer stagnating in the neighborhood of the developer regulating blade.

Japanese Laid-open Patent Application Hei 11-194617 (U.S. Pat. No. 6,067,433) discloses that in order to reduce the development driving torque, as shown in FIG. 14, the developer regulating blade 9 is opposed to the neighborhood of the downstream (with respect to the rotational direction of the developing sleeve 8) one N1 of the repelling N3 pole and N1 pole which are disposed adjacent to each other, so that layer thickness of the developer is regulated simultaneously with the developer being taken up.

With this structure, the developer regulated and removed by the inner side of the developer regulating blade 9, that is the upstream end surface thereof with respect to the rotational direction of the developing sleeve 8, flows along the upstream surface of the developer regulating blade 9, and the additional developer falls into the developing container 2 by the function of the repelling poles N1 and N3. Therefore, no large amount of the developer stagnates at the upstream surface of the developer regulating blade 9, and therefore, the developer is prevented from being subjected to a large pressure.

As a result, the development driving torque is reduced to 1/4 of the conventional level, so that deterioration of the developer is significantly reduced.

However, the structure results in very small region of the developer stagnation. This very reduction of the amount of the stagnating developer leads to non-uniform developer supply from the developer feeding screw 5 onto the developing sleeve 8 and/or toner content non-uniformity due to the carryover, on the sleeve 8, of the developer having low toner content after the development action. These are image defects peculiar to the light load developing device.

Particularly, a material circulation path in the developing device 104 of the vertical arrangement type is as shown in FIG. 15 by an arrow d. Not all of the developer T that is fed from the stirring chamber 4 to the developer chamber 3 through a communicating portion 71 which is one of openings provided at the opposite axial ends of the partition 7 between the developer chamber 3 and the stirring chamber 4, is fed to the downstream end of the first feeding screw 5 in the developer chamber 3. There is a developer which is supplied to the developing sleeve 8 half way and is collected into the stirring chamber after passing through the developing zone.

The feeding of the developer onto the developing sleeve 8 occurs substantially over the entire length of the developing sleeve 8. Therefore, the amount of the developer T fed by the first feeding screw 5 developer chamber 3 gradually decreases in the direction from the upstream end toward the downstream end with respect to the feeding direction. On the other hand, the amount of the developer T fed by the second feeding screw 6 in the stirring chamber 4 tends to gradually increase in the direction from the upstream end toward the downstream end with respect to the feeding direction. Thus, the distribution of the developer T in the developing device 104, as shown in FIG. 15, tends to be non-uniform.

With such a non-uniform amount of the developer in the stirring chamber 4, the amount of the developer is maximum at the downstream, with respect to the developer feeding direction, side of the feeding screw 6 in the stirring chamber 4 adjacent the communicating portion 71 to the upper developer chamber 3 from the lower stirring chamber 4, with the result that developer stagnates to the neighborhood of the developing sleeve 8. Normally, the developer having a low toner content as a result of passing through the developing zone, is collected back into the stirring chamber 4 as indicated by the arrow b in FIG. 14. However, when the stagnated developer extends to the neighborhood of the developing sleeve 8, the developer is carried over on the developing sleeve 8 and passes through the partition 7. It is fed into the developer chamber 3 as indicated by the arrow c, and is fed again into the developing zone without having been stirred by the feeding screw 6 in the stirring chamber 4.

A result, the combination of the longitudinal stirring type and the light load type involves a tendency that low toner content and unstirred developer is fed to the developing sleeve 8, and therefore, image defect such as density non-uniformity or the like attributable to the non-uniformity in the developer layer thickness is produced. Particularly, when the use is made with low flowability toner or spherical toner or the like, the non-uniformity is significant.

The above-described carryover phenomenon is remarkable when the peripheral speed of the developing sleeve 8 is high correspondingly to speed-up of the copying machine or the printer. This is because the high peripheral speed results in the increased developer feeding force of the developing sleeve 8 and the kinetic energy of the developer. Therefore, the problems are increasingly significant in view of the speed-up of the printer and/or copying machine of an electrophotographic type.

More particularly, when the rotational speed of the developing sleeve exceeds 250 mm/sec, or 500 mm/sec, the problems are particularly significant.

It has in considered to extend the distance between N1 and N3 poles which are repelling poles. These, however results in the N3 pole approaches to the S2 pole which is the developing pole. This causes stagnation of the developer at a positioned between S2 pole and N3 pole when the result of toner scattering due to the flapping action of the chains of the developer. This is remarkable when the speed is high.

Accordingly, it is a principal object of the present invention to provide a developing device and an image forming apparatus with which image defects attributable to deterioration of the developer is prevented. It is another object of the present invention to provide a developing device and an image forming apparatus in which carryover of the developer is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a developing device and a drawing according to an embodiment of the present invention will be described in detail. The developing device is used in examples of the image forming apparatus which will be described hereinafter following, but the use is not limited to the examples.

Embodiment 1

Figure 1:
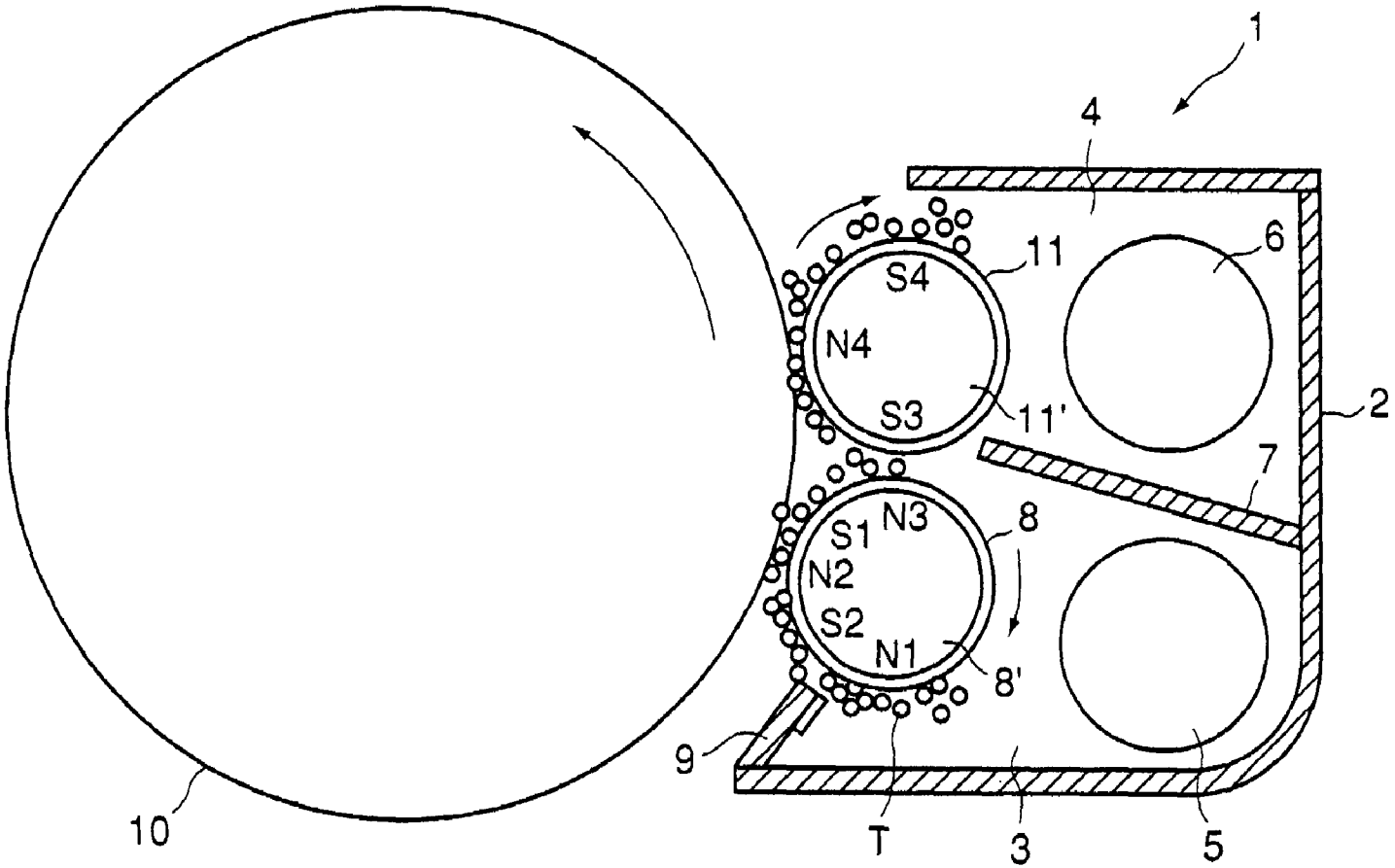
FIG. 1 is a sectional view of a developing device according to an embodiment of the present invention wherein a positional relation between the developing device and the photosensitive drum is shown.
Figure 2:
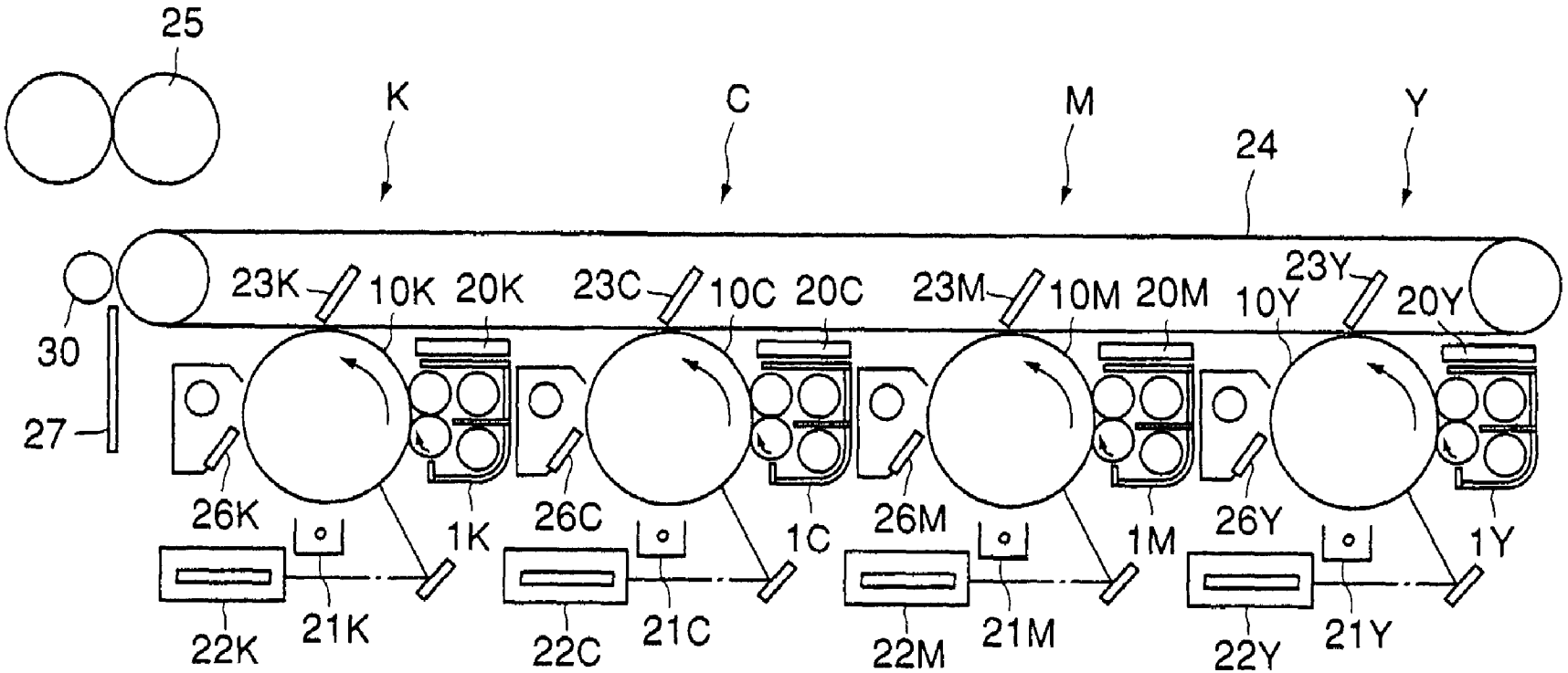
FIG. 2 is a schematic illustration of an image forming apparatus according to an embodiment of the present invention.

FIG. 1 shows a positional relation of the developing device 1 relative to image bearing member (photosensitive drum) 10 in each of Y, M, C, K image forming stations in a full-color image forming apparatus as shown in FIG. 2. The Y, M, C, K image forming stations have substantially the same structure, and they form yellow (Y), magenta (M), cyan (C) and black (K) images, respectively in a full-color image forming operation. In the following descriptions, when reference is made to "developing device 1", it applies to a developing device in each of developing device 1Y, developing device 1M, developing device 1C and developing device 1K in the Y, M, C, K image forming stations..

Referring to FIG. 2, the operations of the entire image forming apparatus will be described.

The photosensitive drum 10 (image bearing member) is rotatably provided in image forming apparatus, the photosensitive drum 10 is uniformly charged by a primary charger 21 and is then exposed to light modulated in accordance with information signal by a light emission element 22 such as a laser device. The latent image is visualized into a toner image by the developing device 1 through a process which will be described hereinafter. The visualized image (developed image or toner image) is transferred by a first transfer charger 23 onto a transfer medium sheet 24 at each of the image forming stations, and the toner images cartridge transferred onto a transfer sheet 27 (recording material) by a second transfer charger 30. The toner image transferred onto the recording material is fixed by a fixing device 25 into a permanent image. The untransferred toner is removed from the photosensitive drum 10 by a cleaning device 26. The toner consumed by the image formation is replenished from the toner supply container 20.

In this example, the toner images are temporarily transferred (primary transfer) from the photosensitive drums 10M, 10C, 10Y, 10K onto the transfer medium sheet 24 (intermediary transfer member), and then the toner images are altogether transferred onto the transfer sheet (secondary transfer). However, the present invention is applicable to another type of image transfer system, for example, a transfer material feeding member for feeding the recording material by the image forming stations M, C, Y, K is provided in place of the transfer medium sheet 24, and the toner images are directly transferred onto the transfer sheet carried on the transfer material feeding member.

Referring back to FIG. 1, the operation of the developing device 1 will be described. The developing device 1 of this embodiment comprises a first developing sleeve 8 (developer carrying member) provided in a developing container 2 in which are two component developer including non-magnetic toner and magnetic carrier, and a regulating blade 9 (developer regulating means) for regulating are layer thickness of the developer carried on the surface of the developing sleeve 8. The regulating blade 9 is disposed at a lower position of the developing sleeve 8.

The developing device further comprises a second developing sleeve 11 opposed to the first developing sleeve 8 at an upper portion of the first developing sleeve 8, and a partition 7 extending parallel with the developing sleeve 8 at a substantially central portion of the developing container 2 to provide a developer chamber 3 and a stirring chamber 4 which takes an upper position, wherein the developer is contained in the developer chamber 3 and the stirring chamber 4.

There is provided an opening at a position of the developing container 2 corresponding to the developing zone faced to the photosensitive drum 10. The first developing sleeve 8 and the second developing sleeve 11 are partly exposed through the opening to the photosensitive drum 10. The first and second developing sleeves 8, 11 are made of non-magnetic material, and contain therein magnet rollers 8 and 11 (first and second magnetic field generating means) which are non-rotatable. The first magnet roller 8' in the first developing sleeve 8 has a developing pole N2, and magnetic poles S1, S2, N1, N3 for feeding the developer T, and the second magnet roller 11' in the second developing sleeve 11 has a developing pole N4 and magnetic pole S3, S4 poles for feeding the developer. Among these magnetic poles, the N1 pole and the N3 pole have the same magnetic polarity to provide a repelling magnetic field; and the S3 pole and the S4 pole have the same magnetic polarity to provide a repelling magnetic field, thus providing barriers against the developer.

In this embodiment, the developing sleeves 8, 11 rotate in the same direction as indicated by the arrows in the Figure, codirectionally with the peripheral movement of the surface of the photosensitive drum 10. The sleeves moves from a lower portion toward an upper portion. Thus, the developer T is taken up from the developer chamber 3 (lower part provided by the partition 7 in the developing container 2), and the developer T after being subjected to the developing action is returned into the stirring chamber 4 (upper part).

The description will be made as to the motion of the developer T from the developing sleeves 8, 11 to the photosensitive drum 10. The two component developer T fed by a first feeding screw 5 in the developer chamber 3 is taken up by the magnetic force of the N1 pole in the first developing sleeve 8 and is conveyed in the rotational direction of the developing sleeve 8. By cooperation between the regulating blade 9 and the magnetic pole S2 positioned opposed thereto, the layer thickness of the developer is magnetically regulated. The regulated developer is conveyed to a first developing zone (developing magnetic pole N2) where the first developing sleeve 8 is opposed to the photosensitive drum 10 to supply t developer T to the latent image formed on the photosensitive drum 10, thus developing t latent image.

The developer T, after finishing the first development action on the first developing sleeve 8, passes by the S1 pole in the rotational direction of the developing sleeve 8 upwardly, and is then is brought over to the second developing sleeve 11 at a position where the sleeves 8 and 11 are closed to each other and which is between the N3 pole of the magnet 8' in t developing sleeve 8 and the S3 pole in the magnet 11' in the developing sleeve 11.

Figure 3:
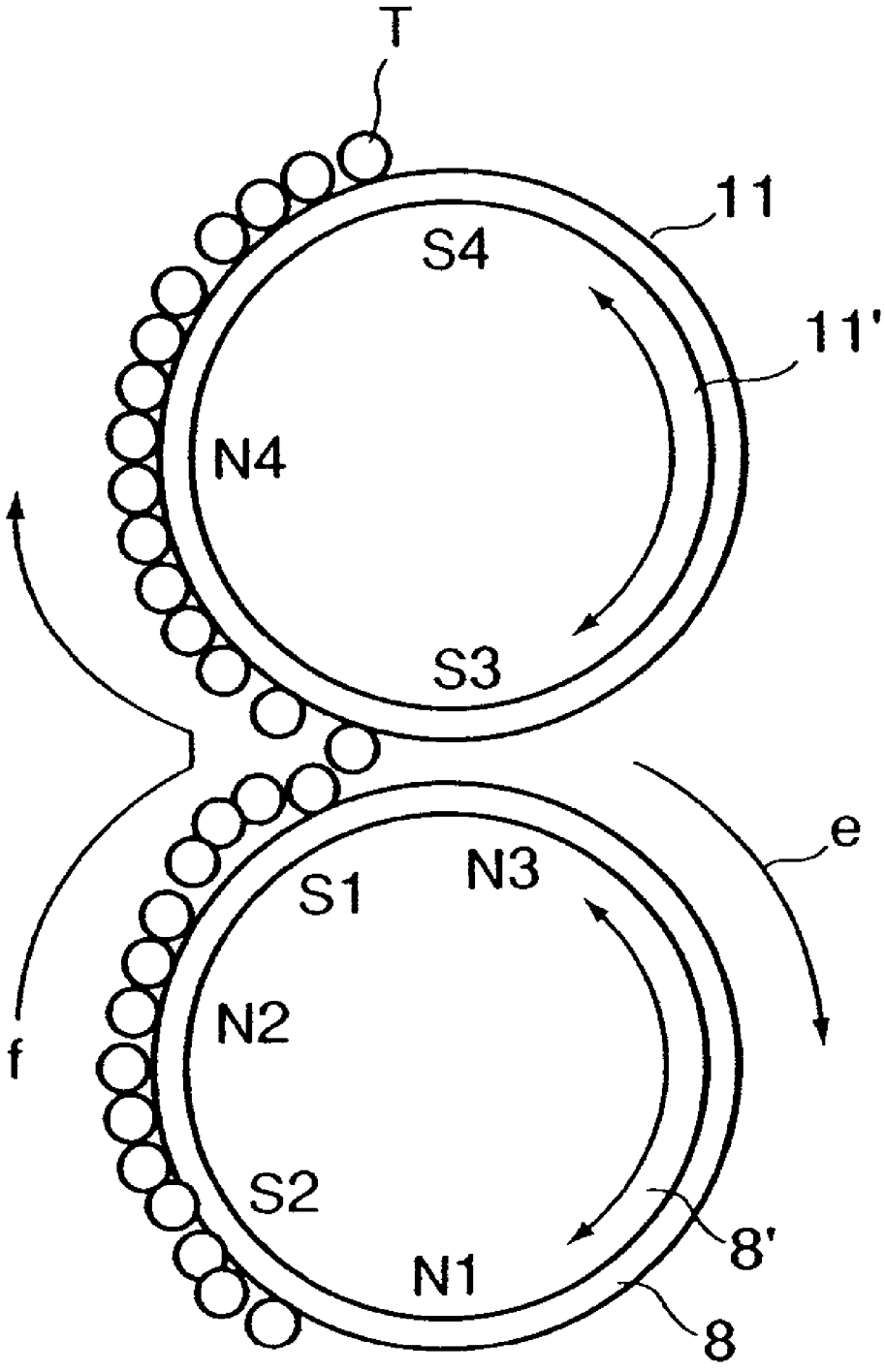
FIG. 3 is a large review of a developer carrying member of a developing device according to an embodiment of the present invention.

Referring to FIG. 3 which is an enlarged view of the first developing sleeve 8 and the second developing sleeve 11, t flow of the developer T will be described. A repelling magnetic field is formed between the first magnetic pole N1 of the first magnet 8' in the first developing sleeve 8 and the second magnetic pole N3 which is upstream thereof with respect to the rotational direction of the developing sleeve 8 and which has the same polarity, and a repelling magnetic field is formed between the third magnetic pole S3 of the second magnet 11' and the fourth magnetic pole S4. The repelling magnetic field between the N1 pole and the N3 pole in the developing sleeve 8 and the repelling magnetic field between the S3 pole and the S4 pole in the second developing sleeve 11 are both directed to the same side, more particularly, toward the inside of the developing container 2. The developer T is conveyed on t first developing sleeve 8 and is passed through the first developing zone which is a developing zone of the first developing sleeve 8, and then reaches the position of the second magnetic pole N3 of the magnet 8' by the rotation of the first developing sleeve 8. The developer T is unable to pass through the minimum gap between the sleeves 8 11 under the function of the repelling magnetic field with the downstream first magnetic pole N1 as indicated by an arrow e, and therefore, the developer T is not carried over on the developing sleeve 8, but the developer T is transferred onto the second developing sleeve 11 from the N3 pole position of the first developing sleeve 8 along the lines of sleeve 8 extending toward the third magnetic pole S3 of the magnet 11' in the second developing sleeve 11 and is conveyed on the second developing sleeve 11. The developer T reaches the second developing zone where t N4 pole is provided in the magnet 11', and is then used again for the development. It is thereafter conveyed to the second feeding screw 6 provided in the stirring chamber 4.

The first and second developing sleeves 8, 11 are supplied with a developing bias voltage which is in the form of an AC biased DC voltage from a voltage source in order to enhance the development efficiency (application rate of the toner to the latent image). The developing bias applied to the second developing sleeve 11 may comprise only a DC voltage component, but the development efficiency is enhanced by applying a voltage which is in the form of an AC-biased DC voltage, similarly to the developing bias applied to the first developing sleeve 8. Thus, it is preferable that one or both of the first developing sleeve 8 and the second developing sleeve 11 is supplied with the AC voltage component.

By using two developing sleeves, namely, the developing sleeves 8, 11, the number of the developing actions is doubled so that sufficient amount of the toner can be supplied to the latent image portion on the photosensitive drum 10, so that development efficiency can be enhanced. More particularly, the development efficiency was improved by approx. 30% according to the experiments of the inventors. This means that development efficiency is equivalent even if the peripheral speed is decreased by 30%. Therefore, the deterioration of the developer can be suppressed.

The developer is fed into the stirring chamber 4 by the rotation of the developing sleeve 11, the developer T is scraped off the sleeve by the repelling magnetic field formed between the S3 pole in the second developing sleeve 11 and in the developing container 2 and the S4 pole toward the feeding screw 6 in the stirring chamber 4.

As described in the foregoing, the developer chamber 3 and the stirring chamber 4 are provided with first and second feeding screws 5, 6 as circulating means for stirring, feeding and circulating the developer.

The first feeding screw 5 is extended at a bottom portion in the developer chamber 3 substantially in parallel with the axial direction (development widthwise direction) of the developing sleeve 8 and is rotated to feed the developer T along the axial direction of the developing sleeve 8 at the bottom portion of the developer chamber 3. The second feeding screw 6 is spiral in the opposite helical direction relative to that of the first feeding screw 5, and is disposed substantially in parallel with the first feeding screw 5 at the bottom portion of the stirring chamber 4. It is rotated substantially in the same direction as the first feeding screw 5 to feed the developer in the stirring chamber 4 in the direction opposite the direction with the first feeding screw 5.

Figure 4:
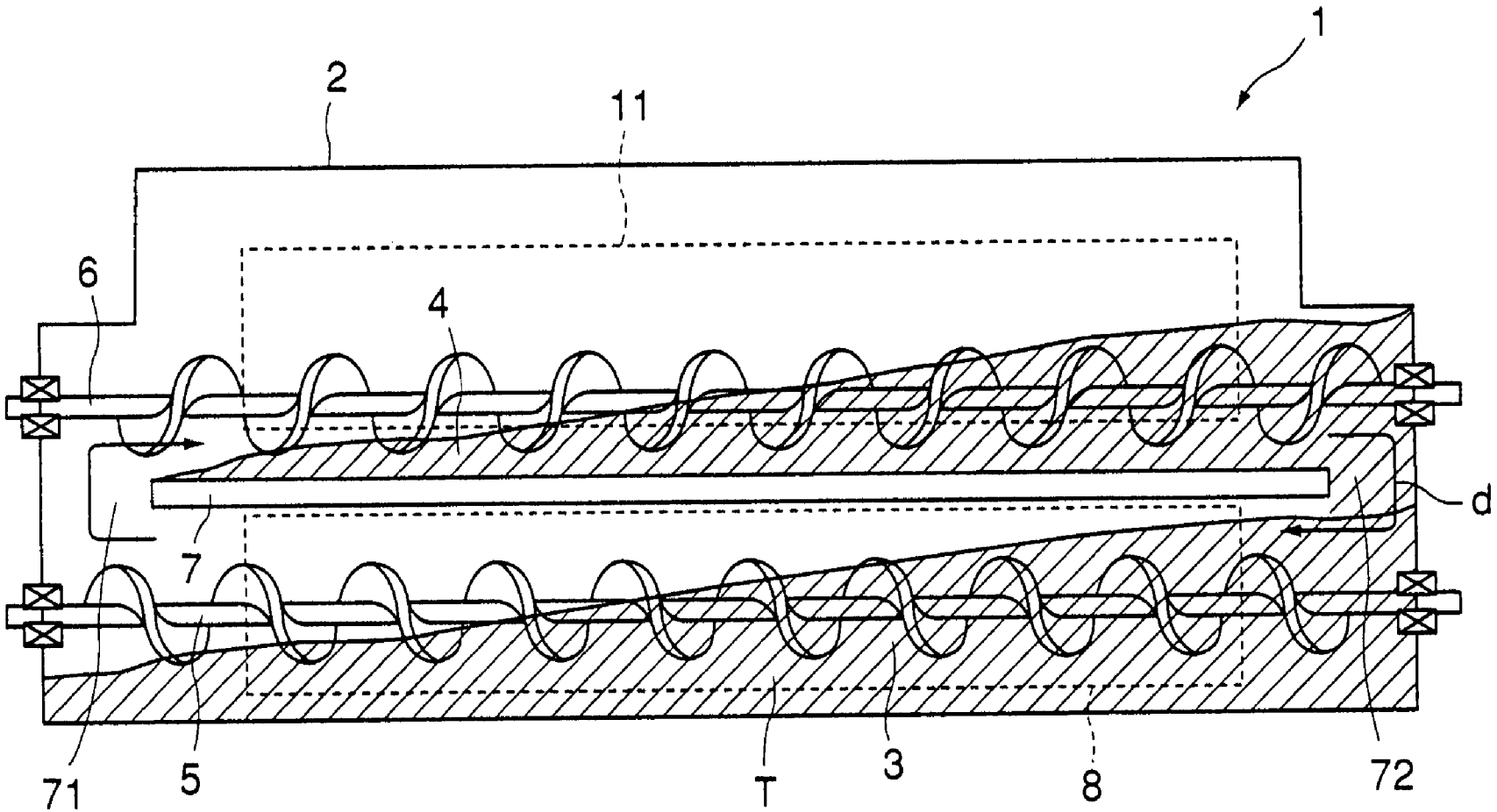
FIG. 4 is a sectional view taken along an axis of a developing device according to an embodiment of the present invention.

In this manner, the developer passes through the openings 71, 72 formed at the opposite end portions of the partition 7 as shown in FIG. 4 by the rotation of the first and second feeding screws 5, 6, so that developer is circulated between the developer chamber 3 and the stirring chamber 4 in the direction d.

In this embodiment, the developer chamber and the stirring chamber are vertical wherein the stirring chamber is above the developer chamber, as contrasted to the conventional developing device 103. The developer moves by the gravity from the stirring chamber 4 into the developer chamber 3, and the developer moves from t developer chamber 3 into the stirring chamber 4 by the pressure of the developer.

As described hereinbefore, the deterioration of the developer occurs at the position where the pressure of the developer is the maximum. In this embodiment, this is downstream portion with respect to the developer feeding direction of the feeding screw 6 in the stirring chamber 4 where the toner is supplied. The level of the developer powder is highest at the communicating portion 72, where the deterioration may occur. However, since the developer of the developer from the stirring chamber 4 into t developer chamber 3 occurs from the lower side to the upper side, the developer circulation is caused by the gravity at the communicating portion 72 from the stirring chamber 4 into the developer chamber 3, and therefore, the developer is substantially free of stress.

The motion of the developer from the developer chamber 3 into the stirring chamber 4 is caused by the developer powder pressure at the communicating portion 71 from the lower side to the upper side. The balance of the surface level of the developer powder is as shown in FIG. 4 wherein the surface level of the developer powder is low at the downstream side in the developer chamber 3, since the developer T is subjected to the developing operation. Therefore, the amount of the developer and the developer feeding force are regulated such that circulation is not caused by the developer powder pressure. For this reason, the portion where the stress is applied is small, which beans that deterioration of the developer is less.

In this embodiment, the peripheral speed of the sleeve could be reduced by 300 own using two sleeves according to this embodiment, and the stress of the developer could be substantially eliminated by disclosing the developer chamber 3 at a lower side and the stirring chamber 4 at the upper side.

The experiments with the developing device of this embodiment, it has been confirmed that developer deterioration speed can be reduced to ⅓ of the conventional developing device.

Generally, the deterioration of the developer is particularly remarkable when the peripheral speed of the developing sleeve is increased in order to raise the copying or printing speed. More particularly, when the rotational speed of the developing sleeve exceeds 250 mm/sec, or inter alia exceeds 500 mm/sec, the problems are significant. When the rotational speed of the developing sleeve exceeds 1000 mm/sec, a problem of toner scattering from the developing sleeve arises due to the centrifugal force. From this standpoint, the present invention is particularly suitable to a high-speed developing device in which the peripheral speed of the developing sleeve is not less than 250 mm/sec and not more than 1000 mm/sec.

Thus, the development efficiency is improved, and the deterioration of the developer can be prevented according to the above-described Embodiment wherein the circulating means for circulating and stirring the developer in the developer container comprises two developing sleeves one of which takes a relatively upper position and the other of which takes a relatively lower position, and wherein the developer chamber for supplying the developer to the developing sleeve takes a relatively lower position, and the stirring chamber for collecting the developer after it is presented for the developing action takes a relatively upper position. Therefore, a developing device and an image forming apparatus having the same can be provided wherein the image defect such as density non-uniformity attributable to the deterioration of the developer is avoided, and therefore, satisfactory image formations are maintained.

Embodiment 2

Figure 5:
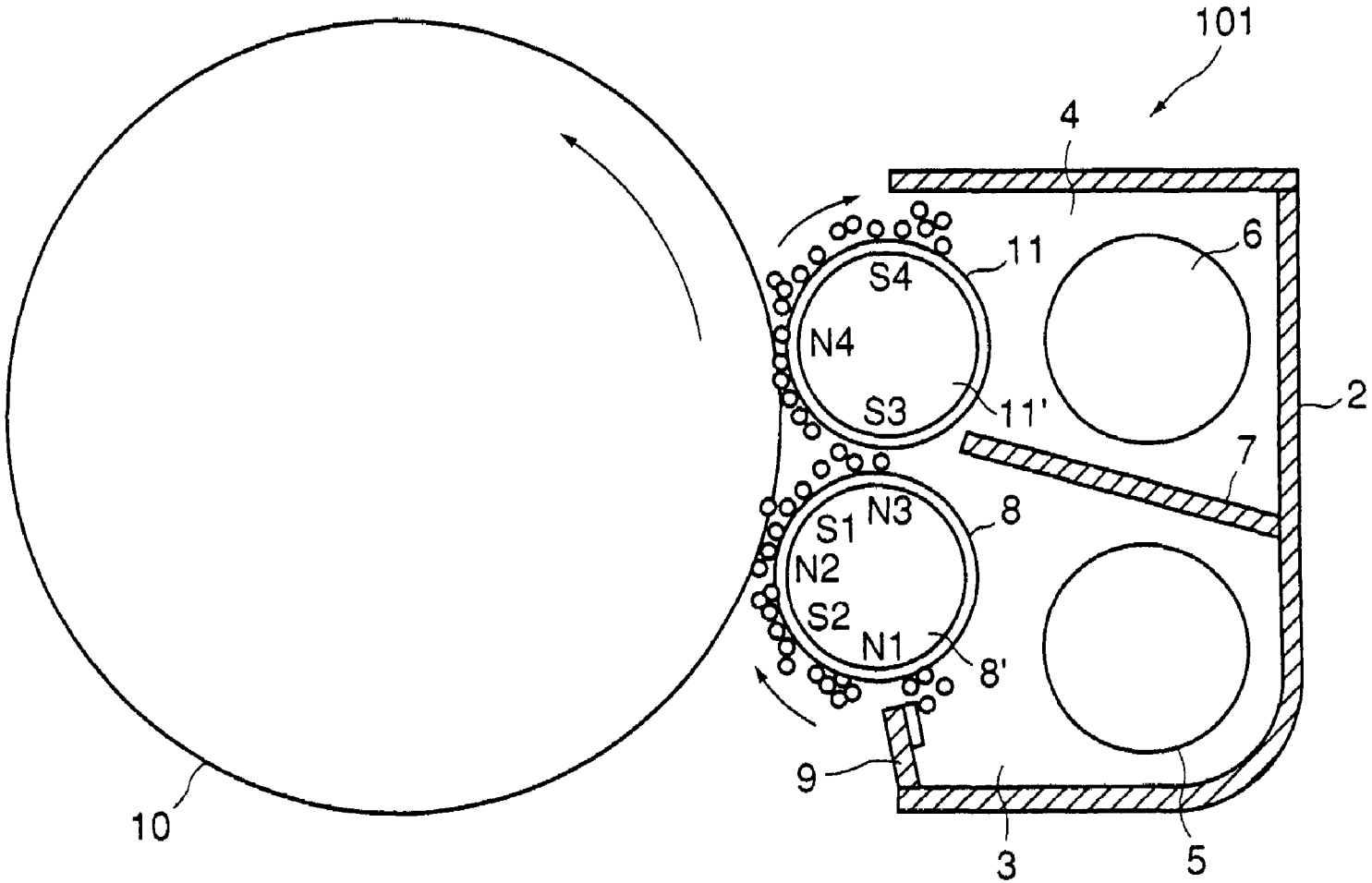
FIG. 5 is a sectional view illustrating a positional relation between the photosensitive drum and a developing device according to another embodiment of the present invention.

Referring to FIG. 5 a developing device according to Embodiment 2 will be described.

The developing device of this embodiment is similar to that of Embodiment 1. However, in the developing device 100 of this embodiment, the regulating blade 9 is opposed to a neighborhood of a first magnetic pole N1 which is a downstream side magnetic pole of the first and second magnetic poles N1, N3 which are provided in the first developing sleeve and which form the repelling magnetic field with respect to the rotational direction of the developing sleeve 8, by which the regulation of the layer thickness for the developer is effected simultaneously with taking the developer up.

This arrangement per se is known as means with which the developing device torque can be significantly reduced as disclosed in Japanese Laid-open Patent Application Hei 11-194617. However, if this is used with a single developing sleeve structure or with the horizontal arrangement, the developer stagnating region is so small that developer is carried over on the sleeve with a result of non-uniformity in the toner content.

However, according to this embodiment, the use is made with two developing sleeves and the vertical arrangement so that carryover of the developer can be substantially completely prevented. The experiments with the developing device of this embodiment were carried out, and it was confirmed that developer deterioration speed was reduced to ¼ of the deterioration with the developing device 1 of Embodiment 1.

Thus, according to this embodiment, the regulating blade is opposed to the neighborhood of the first magnetic pole which is the downstream one of the repelling poles provided in the first developing sleeve with respect to the rotational direction of the developing sleeve, and two developing sleeves are used, by which the deterioration of the developer can be significantly reduced.

Embodiment 3

Figure 6:
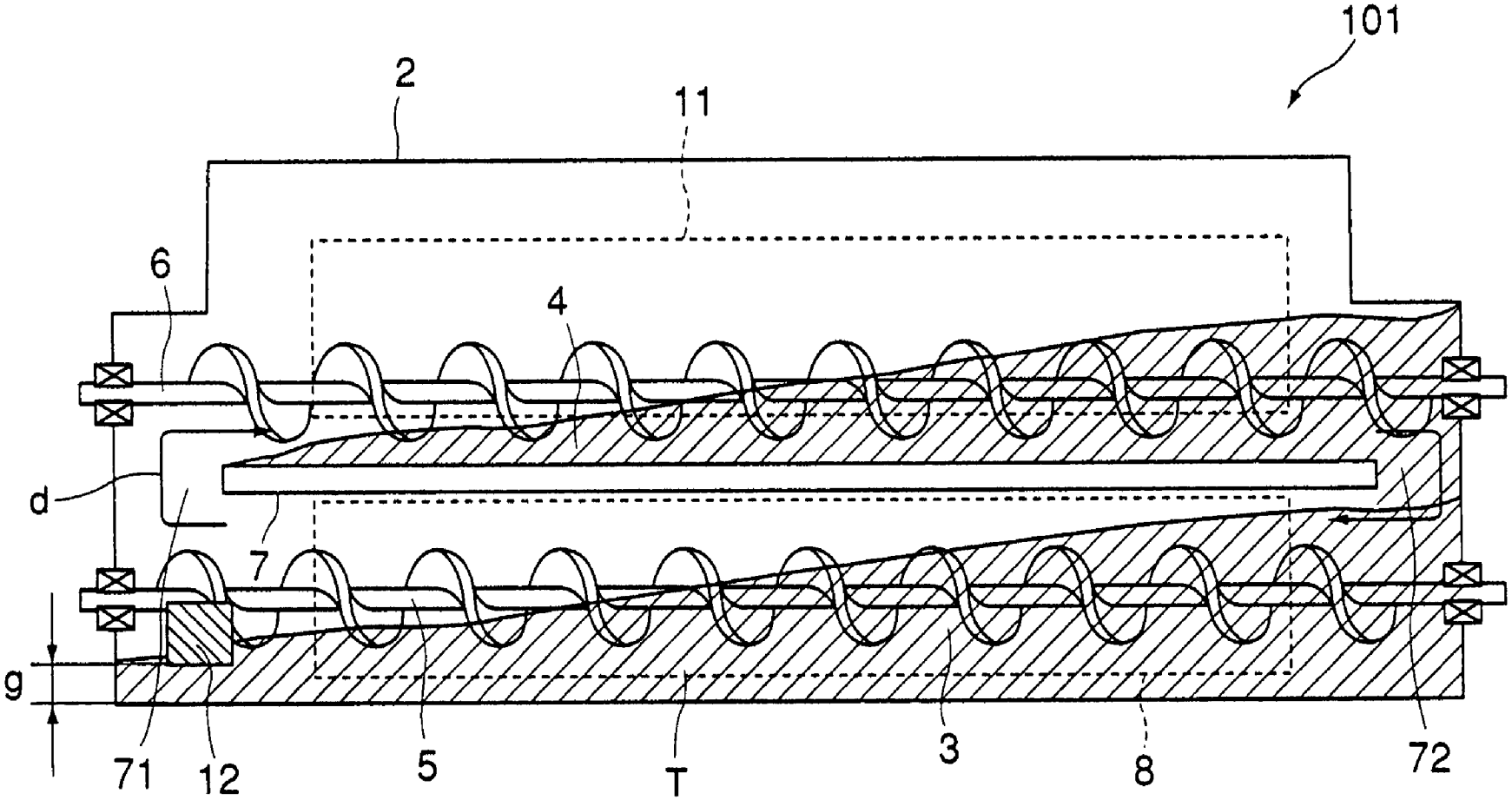
FIG. 6 is a sectional view taken along the axis of the developing device according to this embodiment of the present invention.

Referring to FIG. 6, Embodiment 3 of this invention will be described. FIG. 6 is and axial sectional view of the developing device 101 according to this embodiment.

The developing device of this embodiment has substantially the similar structure to the developing device 1 of Embodiment 1. However, in this embodiment, there is provided a discharge opening 12, in the outer wall adjacent a most downstream portion of the developer chamber 3 wall, for discharged the developer when the height of the surface level of the developer exceeds a predetermined level (indicated by g in the Figure).

When the developer T said by the feeding screw 5 in the developer chamber 3 is not taken up on the first developing sleeve 8 and is accumulated in the developer stagnation portion at the most downstream portion of the developer chamber 3, the surface level of the power of the developer rises. Even in such a case, the developer is automatically discharged through the developer discharge opening 12 when the level exceeds the predetermined level g. The discharged developer T is fed into a procedural toner case (unshown). Therefore, the level of the developer power surface at the downstream portion of the developer chamber 3 can be maintained constant.

As a result, the stress of the developer T at the position where the developer is taken up from the developer chamber 3 into the stirring chamber 4 through the communicating portion 71 can be reduced, so that developer deterioration speed can be further reduced.

Embodiment 4

Embodiment 4 is characterized by the toner supply container 20 containing magnetic carrier particles mixed with the supply toner.

With the structure, even if the developer (toner and magnetic carrier) is discharged through the developer discharge opening 12 in Embodiment 3, the developer is supplied from the toner supply container 20, so that undeteriorated magnetic carrier can be automatically supplied, so that triboelectric charge can be stabilized for long-term operations. As a result, the developer lifetime can be further extended.

According to this embodiment, the circulating means for stirring, feeding and circulating the developer in the developing device are substantially vertically arranged, and two developing sleeves are used, by which the development efficiency is improved with the suppressed deterioration of the developer.

Therefore, the image defect such as density non-uniformity or the like attributable to the deterioration of the developer can be eliminated.

The division of the developing container into the developer chamber and the stirring chamber is generally employed in developing devices using two component developer. However, Embodiments 1–3 are not limited to the developing devices using a two component developer bodies applicable to a developing device using a one component developer not containing carrier particles. In the case of using the one component developer, the present invention is used from the standpoint of the suppression of the deterioration of the developer attributable to the carryover of the developer particles.

As described in the foregoing, according to this embodiment, there is provided a developing device in which the circulating means for stirring, feeding and circulating the developer in the developing device are arranged substantially vertically, two developer carrying members are employed, wherein the developer chamber for supplying the developer into the first development carriage particularly member takes a relatively lower position, and stirring chamber for collecting from the second current image bearing member the developer having passed through the first developing zone and the second developing zone takes a relatively a proposition, by which the development efficiency is improved, and the stress of the developer in the developing container is reduced, thus suppressing the deterioration of the developer. Therefore, a compact and high-speed developing device with which the image defect such as density non-uniformity or the like due to the deterioration of the developer can be avoided, is provided.

Embodiment 4

Figure 7:
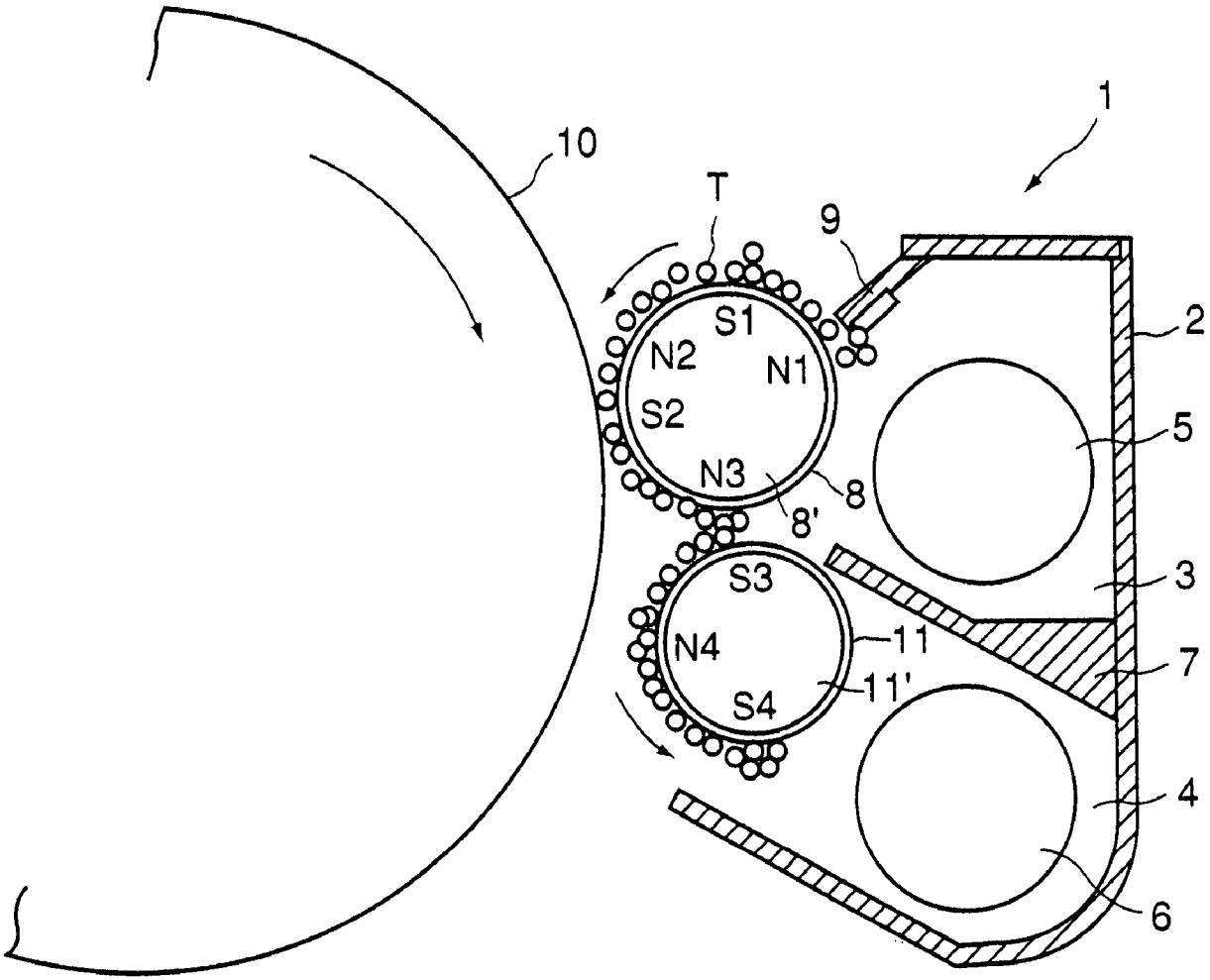
FIG. 7 is a sectional view illustrating a relationship between the photosensitive drum and a developing device according to an embodiment of the present invention.
Figure 8:
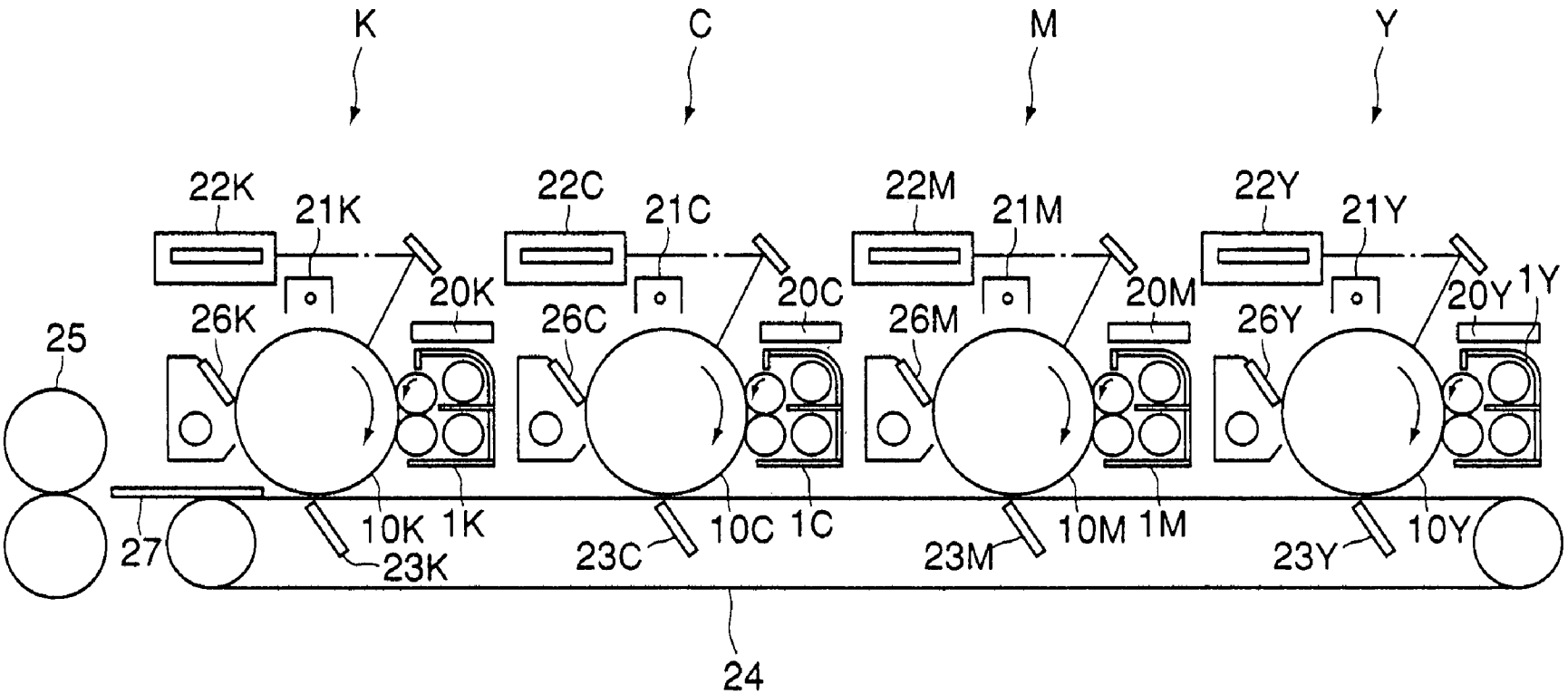
FIG. 8 is a schematic illustration of an image forming apparatus according to an embodiment of the present invention.

FIG. 7 shows a positional relation of the developing device 1 relative to image bearing member (photosensitive drum) 10 in each of Y, M, C, K image forming stations in a full-color image forming apparatus as shown in FIG. 8. The structures of some elements are fundamentally the same as those in the foregoing Embodiments, but the description will be made for them for better understanding of this embodiment. The Y, M, C, K image forming stations have substantially the same structure, and they form yellow (Y), magenta (M), cyan (C) and black (K) images, respectively in a full-color image forming operation. In the following descriptions, when reference is made to "developing device 1", it applies to a developing device in each of developing device 1Y, developing device 1M, developing device 1C and developing device 1K in the Y, M, C, K image forming stations.

Referring to FIG. 2, the operations of the entire image forming apparatus will be described.

The photosensitive drum 10 (image bearing member) is rotatably provided in image forming apparatus, the photosensitive drum 10 is uniformly charged by a primary charger 21 and is then exposed to light modulated in accordance with information signal by a light emission element 22 such as a laser device. The latent image is visualized into a developed image (toner image) by the developing device 1 through a process which will be described hereinafter.

The visualized image (developed image or toner image) is transferred by a first transfer charger 23 onto a transfer sheet 27 (recording material). The toner image transferred onto the recording material is fixed by a fixing device 25 into a permanent image. The untransferred toner is removed from the photosensitive drum 10 by a cleaning device 26. The toner in the developer consumed by the image formation is replenished from the toner supply container 20. In this embodiment, the toner images are transferred from the photosensitive drums 10M, 10C, 10Y and 10K directly onto the transfer sheet 27 (recording material) fed to the transfer material feeding sheet 24. The present invention is applicable to the image forming apparatus in which an intermediary transfer member is provided in place of the transfer sheet feeding sheet 24 so that toner images are temporarily transferred onto the intermediary transfer member from the photosensitive drums 10M, 10C, 10Y, 10K (primary transfer), and then the toner images are altogether transferred onto the transfer sheet (secondary transfer).

Referring to FIG. 7, the operation of the developing device 1 will be described. In this embodiment, the developing device 1 comprises a developing container 2 for containing a two component developer comprising non-magnetic toner particles and magnetic carrier particles, a first developing sleeve 8 (first developer carrying member) and a regulating blade 9 (developer regulating member) for regulating of layer thickness of the developer carried on the surface of the developing sleeve 8, the regulating blade 9 being disposed opposed to the developing sleeve 8.

The developing container 2 is divided into a developer chamber 3 and a stirring chamber 4 by a partition 7 extending perpendicularly to the shade of the growing substantially at the center of the developing container 2, and developer is accommodated in the developer chamber 3 and the stirring chamber 4, wherein the developer chamber 3 and the stirring chamber 4 are substantially vertically arranged.

Figure 15:
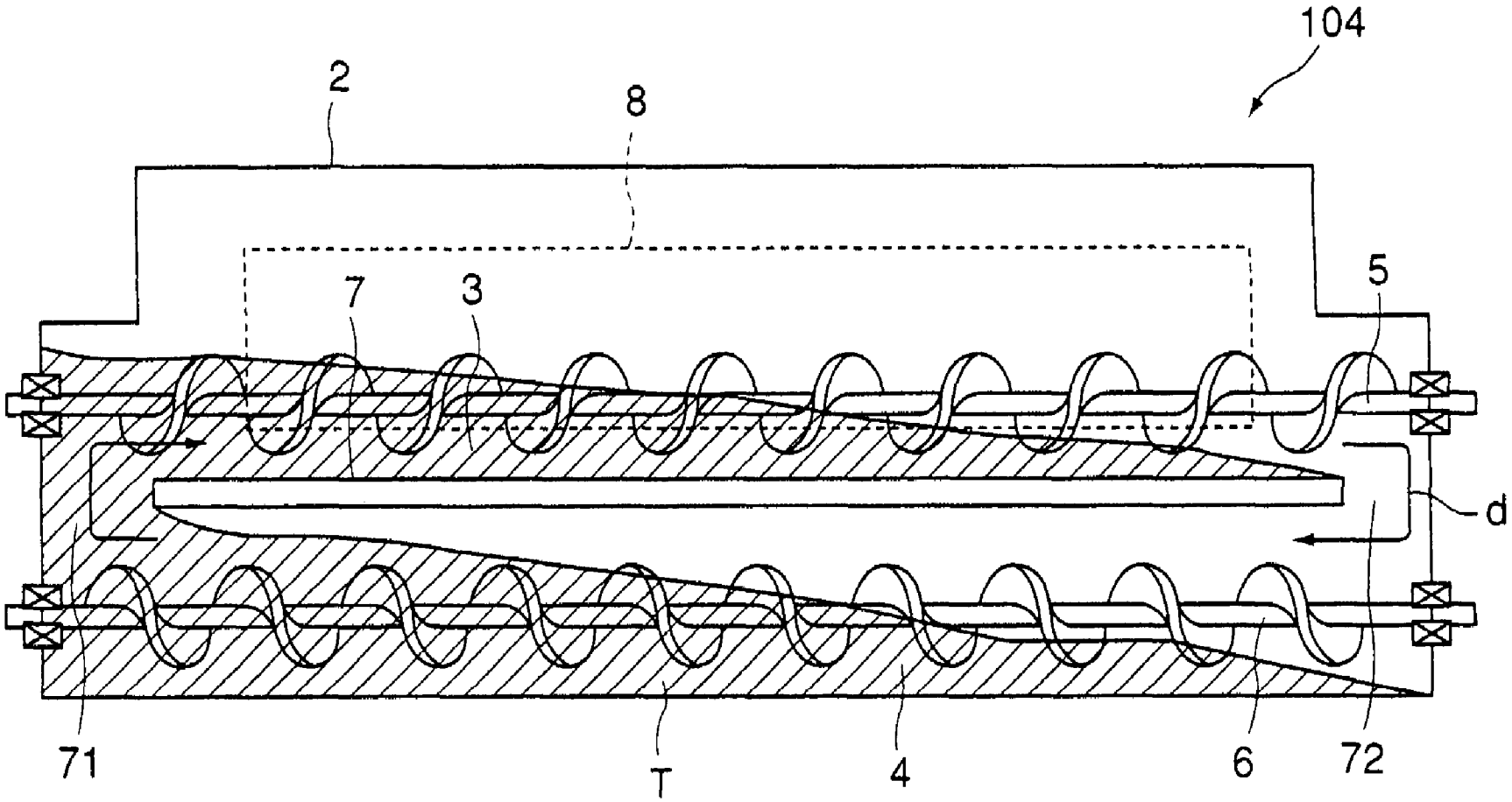
FIG. 15 is a sectional view of a conventional developing device.

The developer chamber 3 and the stirring chamber 4 are provided with first and second feeding screws 5, 6, respectively, which are circulating means for stirring, feeding and circulating the developer T in the developing container 2. The first feeding screw 5 is extended substantially along the axis of the developing sleeve 8 at the bottom portion of the developer chamber 3 and functions to feed the developer T uniaxially on the axis in the developer chamber 3 by its rotation. The second feeding screw 6 is disposed at the bottom portion in the stirring chamber 4 and is extended substantially parallel with the first feeding screw 5 and functions to feed the developer T in the stirring chamber 4 in the direction opposite to the feeding direction of the first feeding screw 5. In this manner, the rotations of the first and second feeding screws 5, 6 circulate the-developer T, similarly to the structure shown in FIG. 15, between the developer chamber 3 and the stirring chamber 4 through an opening (communicating portion) (communicating portions 71, 72 in FIG. 15) at the opposite and portions of the partition 7.

In addition, there is provided an opening at a position of the developing container 2 corresponding to the developing zone opposed to the photosensitive drum 10. The developing sleeve 8 (first developer carrying member) is disposed in the opening so as to be partly-exposed to the photosensitive drum 10. The developing sleeve 8 is rotatable. The developing sleeve 8 is made of non-magnetic material and contains a magnet roller 8' (first magnetic field generating means) which is not rotatable. The magnet roller 8' has a developing pole S2 and magnetic poles S1, N1, N2, N3 for feeding the developer. The first magnetic pole N3 and the second magnetic pole N1 have the same polarity and are disposed at an inner part of the developing container 2 adjacent to each other so that are repelling magnetic field is formed between these poles to provide a barrier against the developer T so as to separate the developer T in the stirring chamber 4.

A description will be made as to the light load developing device. In this embodiment, in other to prevent deterioration of the developer due to the provision of the developer regulating portion 9, a regulating blade 9 (developer regulating member) is provided at an upper portion of the developer chamber 3 at a position 5 degree is downstream of the second magnetic pole N1 which is a downstream one of the repelling poles N1 and N3 of the magnet 8' with respect to the rotational direction of the sleeve 8. There is provided a 400 μm clearance between the regulating blade 9 and the developing sleeve 8 at the closest point. The distance (SB distance) between the sleeve 8 and blade 9 is determined in consideration of the magnetic force of the N1 pole and an amount of the developer on the sleeve 8 (approx. 30 mg/cm2 in this embodiment).

The regulating blade 9 in this embodiment comprises a blade of non-magnetic material and a magnetic plate of magnetic material having a thickness of 0.3 mm. The magnetic plate is bonded to a side surface of the blade.

Through the inventors' experiments, it has been found that is preferable to disclose the regulating blade 9 within a range of X°/2 downstream from the maximum magnetic flux density position of the N1 pole with respect to the rotational direction of the developing sleeve 8 where X° is a half-peak width of the N1 pole.

The developing sleeve 8 rotates in the direction indicated by an arrow sense that surface of the developing sleeve moves in the developing zone substantially vertically downward. The developing sleeve 8 carries a layer of the two component developer T having a thickness regulated by the magnetic brush formed by the regulating blade 9 (chain cutting) to the developing zone where the developing sleeve 8 is opposed to the photosensitive drum 10. The developer T is supplied to the latent image formed on the photosensitive drum 10 in the developing zone to develop it. At this time, in order to improve the development efficiency (application rate of the toner to the latent image), the developing sleeve 8 is supplied with developing bias voltage which is in the form of an AC biased DC voltage from the voltage source.

The first feeding screw 5 is extended substantially parallel with the axial direction (developing widthwise direction) of the developing sleeve 8 at the bottom portion of the developer chamber 3. In these embodiments, the first feeding screw 5 includes a rotation shaft of ferromagnetic member and a spiral-shaped blade member of non-magnetic material. The first feeding screw 5 feeds the developer T at the bottom portion in the developer chamber 3 in the direction of the axis of the developing sleeve 8 by its rotation.

Similarly to the first feeding screw 5, the second feeding screw 6 comprises a rotation shaft and a blade member which is spiraled in the rotational direction opposite from the spiral of the first feeding screw 5. It is extended substantially parallel with the first feeding screw 5 at the bottom portion of the stirring chamber 4. It is rotated in the same rotational direction as the first feeding screw 5 to feed the developer T in the direction opposite to the first feeding screw 5 in the stirring chamber 4.

By the rotations of the first and second feeding screws 5, 6, the developer T saturates between the developer chamber 3 and the stirring chamber 4. In the developing device 1 of this embodiment, the developer chamber 3 and that stirring chamber 4 are arranged substantially vertically, therefore, the developer moves substantially upwardly from the developer chamber 3 into the stirring chamber 4 and substantially downwardly from the stirring chamber 4 into the developer chamber 3. Particularly, in the movement from the stirring chamber 4 into the developer chamber 3, the developer is urged out roundly by the pressure of the developer stagnated at the end.

In this case, as described in the description regarding the prior art examples, the developer tends to stagnate in the stirring chamber 4 adjacent the communicating portion 71 where the developer is transferred from the stirring chamber 4 into the developer chamber 3 so that surface level of the powder of the developer T is high. As a result, the developer T having the decreased toner content after passing through the developing zone passing is carried over on the developing sleeve 8 and is fed into the developer chamber 3 and again to the developing zone. With the light load developing device of this embodiment, the developer is not easily stagnated at the developing container 2 side of the developer regulating blade 9, therefore, the carryover tends to occur.

A description will be made as to prevention of carryover of the developer on the developing sleeve in this embodiment. In this embodiment, an additional feeding sleeve 11 (second developer carrying means) is disposed at the position opposing to the developing sleeve 8 at the lower portion of the developing sleeve 8. The feeding sleeve 11 is rotatable in the direction indicated by an arrow (the same direction as the developing sleeve 8).

The feeding sleeve 11 is made of non-magnetic material, and similarly to the developing sleeve 8, the feeding sleeve 11 contains a magnet roller 11' which is non-rotatable second magnetic field generating means, the magnet roller 11' as three magnetic poles, namely magnetic poles S3, S4, N4. Of these magnetic poles, the third magnetic pole S3 and the fourth magnetic pole S4 which have the same polarity are adjacent to each other in the developing container 2 form a repelling magnetic field to provide a barrier against the developer T. The downstream one of the magnetic poles S3 and S4 with respect to the rotational direction of the sleeve 1, that is, the third magnetic pole S3 is opposed to the first magnetic pole N3 of the magnet 8' in the developing sleeve 8 at the position where the sleeves 8, T1 are closest to each other. The N3 pole of the magnet 8' is disposed upstream of the magnetic poles N1, N3 which form the repelling magnetic pole at the developing sleeve 8 side, with respect to the rotational direction of the sleeve 8.

Figure 9:
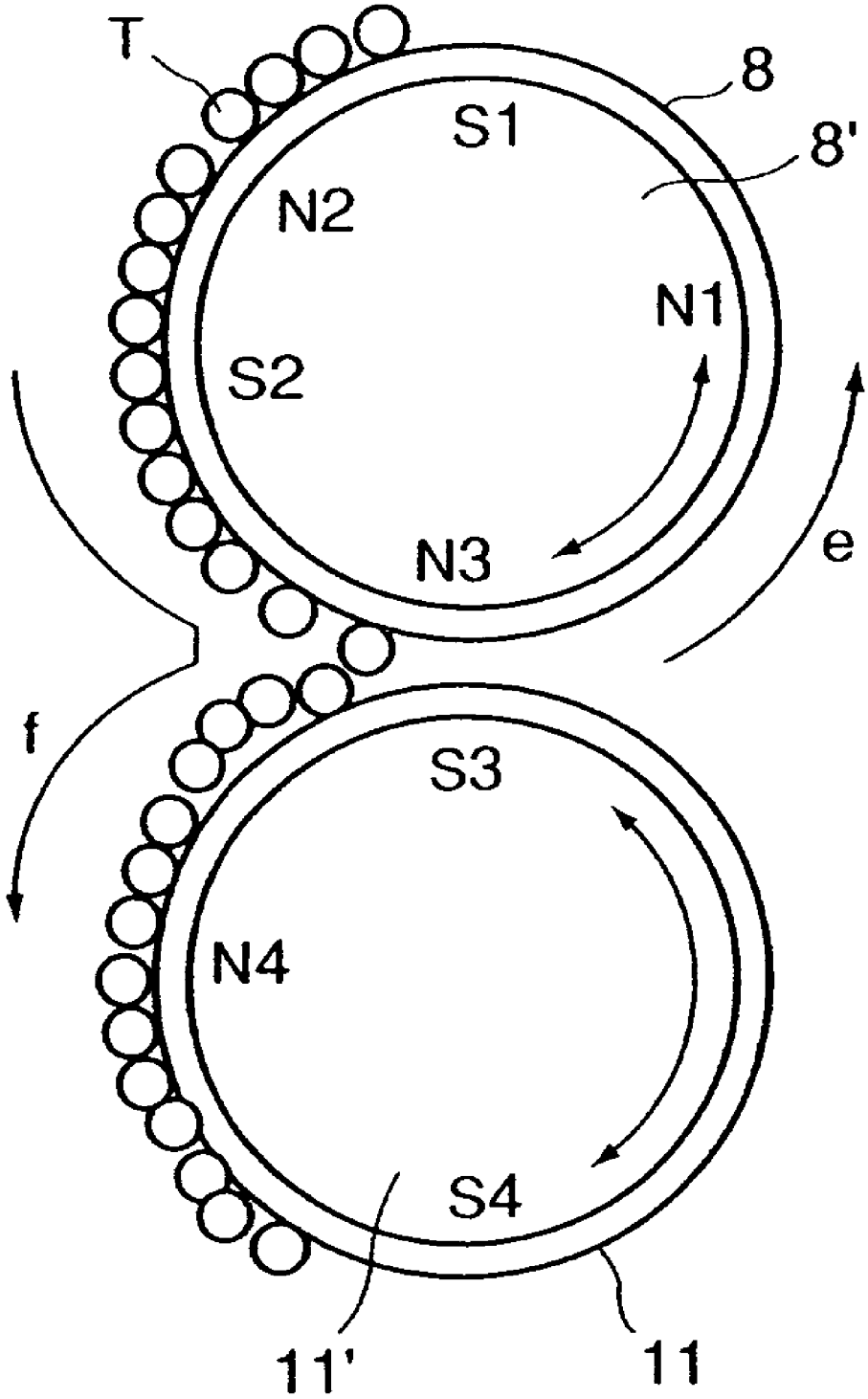
FIG. 9 is a large review of a developer carrying member of a developing device according to an embodiment of the present invention.

Referring to FIG. 9, the description will be made as to the flow of the developer T adjacent the developing sleeve 8 and the feeding sleeve 11 will be described. As has been described in the foregoing, a repelling magnetic field is formed between the first magnetic pole N3 in the developing sleeve 8 and the second magnetic pole N1, and a repelling magnetic field is also formed between the third magnetic pole S3 in the feeding sleeve 11 and the fourth magnetic pole S4. The first magnetic pole N3 in the developing sleeve 8 and the third magnetic pole S3 in the feeding sleeve 11 are close to each other. The repelling magnetic field formed by the magnetic pole N1 and N3 in the developing sleeve 8 and the repelling magnetic field formed by the S3 pole and the S4 pole in the feeding sleeve 11 are oriented in the same direction, that is, toward the inside of the developing container 2.

The developer T is conveyed on the developing sleeve 8 and is passed through the developing zone, and then reaches the position of the first magnetic pole N3 of the magnet 8'. By the repelling magnetic field formed with the downstream second magnetic pole N1, the developer is unable to pass through the closest position where the sleeves 8 and 11 are opposed to each other, and therefore, the developer T is prevented from carrying over on the developing sleeve 8. The developer T, as indicated by an arrow f, moves from the position of the N3 pole in the developing sleeve 8 toward the feeding sleeve 11 along the lines of magnetic force extending toward the third magnetic pole S3 of the magnet 11' in the feeding sleeve 11. The developer T is fed on the feeding sleeve 11 to the second feeding screw 5 in the stirring chamber 4.

Figure 14:
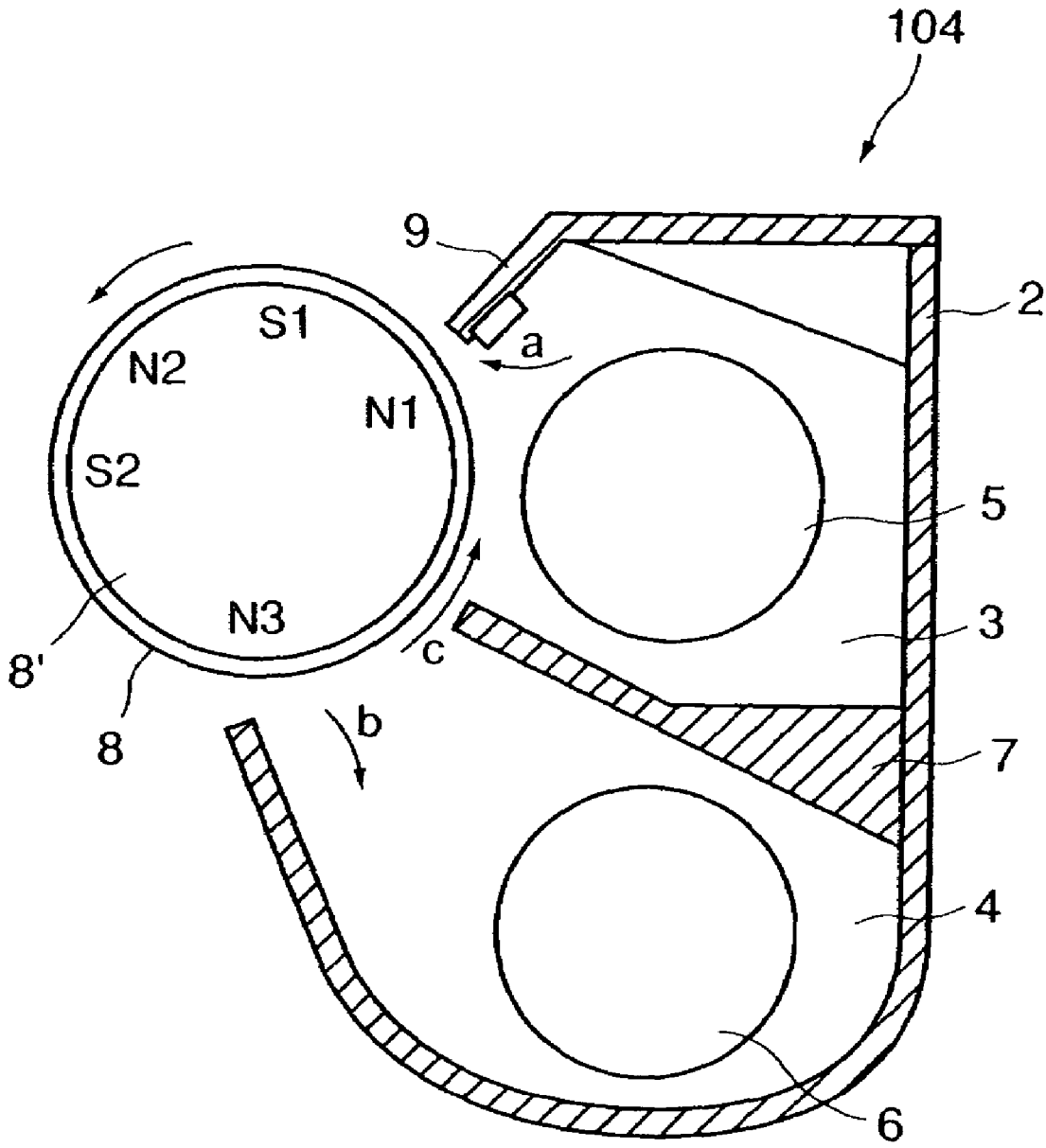
FIG. 14 is an axial sectional view of a conventional developing device.

In the conventional system as shown in FIG. 14 comprising one sleeve 8, the developer is moved in the order of N1–S1–N2–S2–N3 and then N3–N1 as indicated by an arrow c in FIG. 14 so that developer T moves from the inside of the developing container 2 to the outside developing zone and then is returned into the developing container 2. In the case of this movement, the possibility of developer carryover is high. According to this embodiment, the feeding sleeve 11 is provided so as to be opposed to the developing sleeve 8 in the opening of the developing container 2 where the feeding sleeve 11 is opposed to the photosensitive drum 10. Because of this provision, the developer T moves on the developing sleeve 8 to the outside of the developing container 2 along N1–S1–N2–S2–N3, and then the developer T on the developing sleeve 8 is blocked by the repelling magnetic field of the sleeves 8, 11, so that developer T is not as through the gap at the closest portion between the sleeves 8 and 11. The developer T moves to the feeding sleeve 11 and is fed on the feeding sleeve 11 along S3–N4–S4. Then, it is blocked by the repelling magnetic field formed between the fourth magnetic pole S4 and the third magnetic pole S3 in the developing container 2, so that developer T is scraped off the sleeve into the stirring chamber 4. In this manner, the developer T on the developing sleeve 8 is substantially completely scraped off by the feeding sleeve 11, so that carryover of the developer is prevented.

In the conventional developing device 104 shown in FIG. 14, the developer T moves along the main developing pole S2 and the magnetic pole N3, and is scraped into the stirring chamber 4 by the repelling magnetic field formed with the N1 pole. In order to prevent the carryover in the direction indicated by arrow c with this arrangement, a range in which the magnetic force is 0 G between the poles N1 and N2 has to be large, but since the N3 pole constitutes the repelling pole, the magnetic force tends to extend only toward S2 pole, and therefore, the developer tends to stagnate.

However, the developer is transferred smoothly to the feeding sleeve along S2–N3–S3, and therefore, the magnetic lines of force tends to extend toward the S3 pole rather than toward the S2 pole, so that there is less limitation to the position of the N3 pole. Therefore, the distance of the repelling poles on the developing sleeve 8 side can be made large, so that unstirred developer is not supplied to the developing sleeve 8, and therefore, the image defect in this respect can be avoided.

In order to remove the developer T from the developing sleeve 8 by the feeding sleeve 11, it is preferable that magnetic poles of the opposite polarities, that is, the attracting poles are opposed to each other. By doing so, the developer is prevented from passing through the closest position between the sleeves 8 and 11.

In this embodiment, the magnetic poles (N3 pole and S3 pole) of the opposite polarities are opposed to each other adjacent to position where the sleeves are closest to each other. However, a similar scraping effect can be provided by disposing the magnetic poles of the same polarity. In order to prevent the developer T which has been scraped off and fed to the surface of the feeding sleeve 11 from returning to the developing sleeve 8 and being fed thereby, the position where the developer is scraped off the feeding sleeve 11, that is, the other of the repelling magnetic poles, namely, the fourth magnetic pole S4 in this embodiment, is preferably away from the developing sleeve 8.

More particularly, the distance between the magnetic poles of the same polarity constituting the repelling magnetic field on the feeding sleeve 11, that is, the distance between the S3 pole and the S4 pole is preferably large, more particularly, not less than 100°, further preferably not less than 150 and even further preferably not less than 180. Since the distance is larger if the diameter of the feeding sleeve 11 is larger, and therefore, the diameter is preferably not less than 15 mm, and further preferably not less than 20 mm. Although not shown, two or more feeding sleeves may be provided so as to transfer the developer sequentially.

Generally, the carryover phenomenon is remarkable when the copying speed or printing speed is increased by increasing the peripheral speed of the developing sleeve. More particularly, when the rotational speed of the developing sleeve exceeds 250 mm/sec, or inter alia exceeds 500 mm/sec, the problems are significant. When the rotational speed of the developing sleeve exceeds 1000 mm/sec, a problem of toner scattering from the developing sleeve arises due to the centrifugal force. From this standpoint, the present invention is particularly suitable to a high-speed developing device in which the peripheral speed of the developing sleeve is not less than 250 mm/sec and not more than 1000 mm/sec.

As described in the foregoing, according to this embodiment, there is provided a developing device in which the circulating means for stirring, feeding and circulating in developer in the developing device are arranged substantially vertically, a feeding sleeve (second developer carrying means) is provided in the region opposed to the lower portion of the developing sleeve, by which the developer can be completely scraped off the developing sleeve, and therefore, the developer is prevented from being carried over on the developing sleeve. Thus, image defect peculiar to the light load developing device can be avoided.

Embodiment 5

Figure 10:
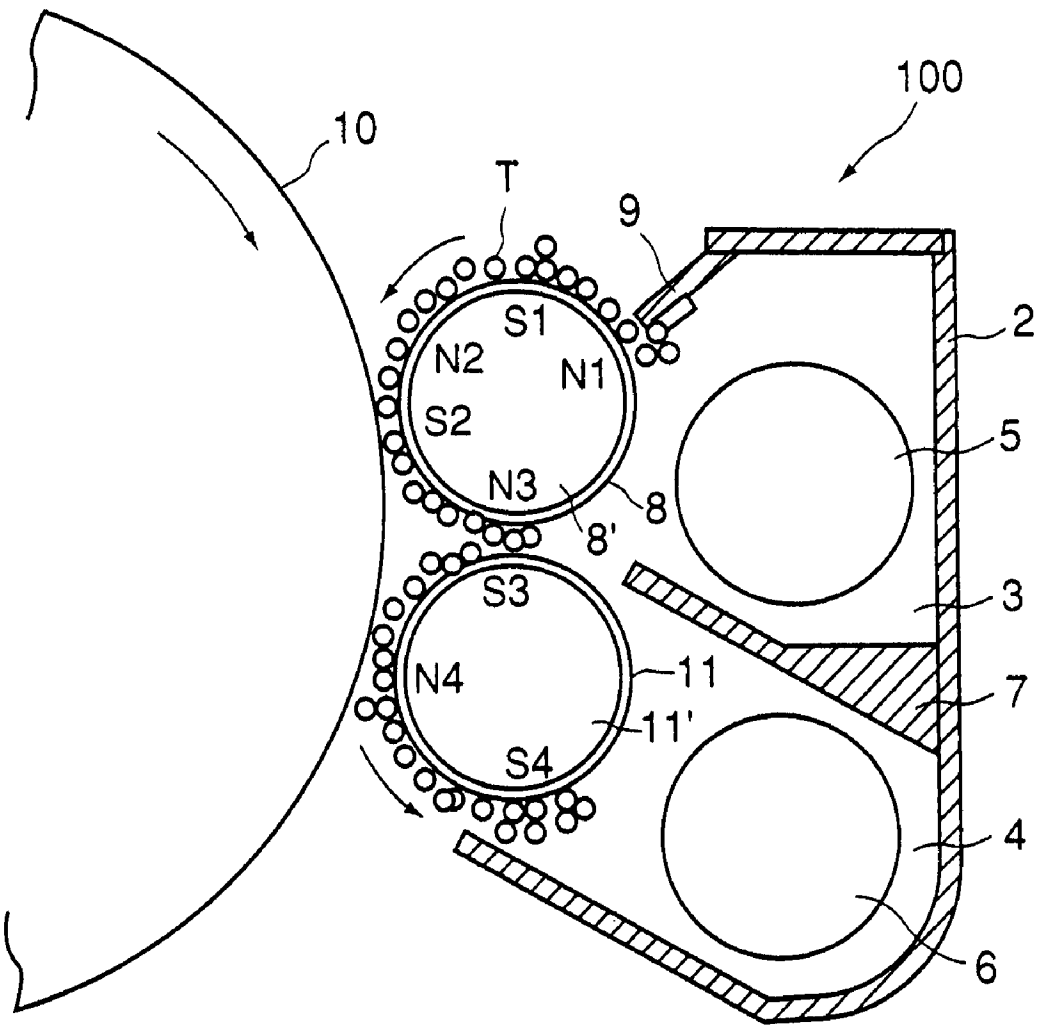
FIG. 10 is a sectional view of a developing device according to a father embodiment of the present invention wherein a positional relationship between the photosensitive drum and the developing device is shown.

Referring to FIG. 10, a developing device 100 according to Embodiment 5 of the present invention will be described.

The structure of this embodiment is similar to that of Embodiment 4 described hereinbefore. However, in this embodiment, the feeding sleeve 11 (second developer carrying member) disposed opposed to the developing sleeve 8 is made close also to the photosensitive drum 10. In addition, the feeding sleeve 11 is supplied with a developing bias voltage so that N4 pole functions as a developing pole effective to further develop the latent image on the feeding sleeve 11.

By doing so, the number of developing actions is doubled, and therefore, the development efficiency is increased. The developing bias applied to the feeding sleeve 11 may contain only a DC voltage component, but application of a voltage in the form of an AC-biased DC voltage similarly to the developing bias voltage applied to the developing sleeve 8, since then the development efficiency is further raised. In other words, the AC voltage is preferably applied to one or both of the developing sleeve and the feeding sleeve.

In this case, the voltages applied to the developing sleeve 8 and to the feeding sleeve 11 are not necessarily the same, but application of the same voltage is preferable since then a common voltage source can be used.

In such a developing device in which the developing action occurs twice by two developer carrying members, the present invention is capable of avoiding an image defect such as density non-uniformity because the toner content distribution of the developer supplied to the developing sleeve is substantially uniform in the axial direction and because the developer is not carried over-on the developing sleeve.

As a result, the peripheral speed of the sleeve can be reduced evening a high-speed copying machine or printer. In other words, the latitude in the design of the high-speed machine can be significantly improved.

In such an image forming apparatus, the developer can be substantially completely removed from the developing sleeve, and therefore, the image defect peculiar to the light load developing device can be avoided.

Embodiment 6

Figure 11:
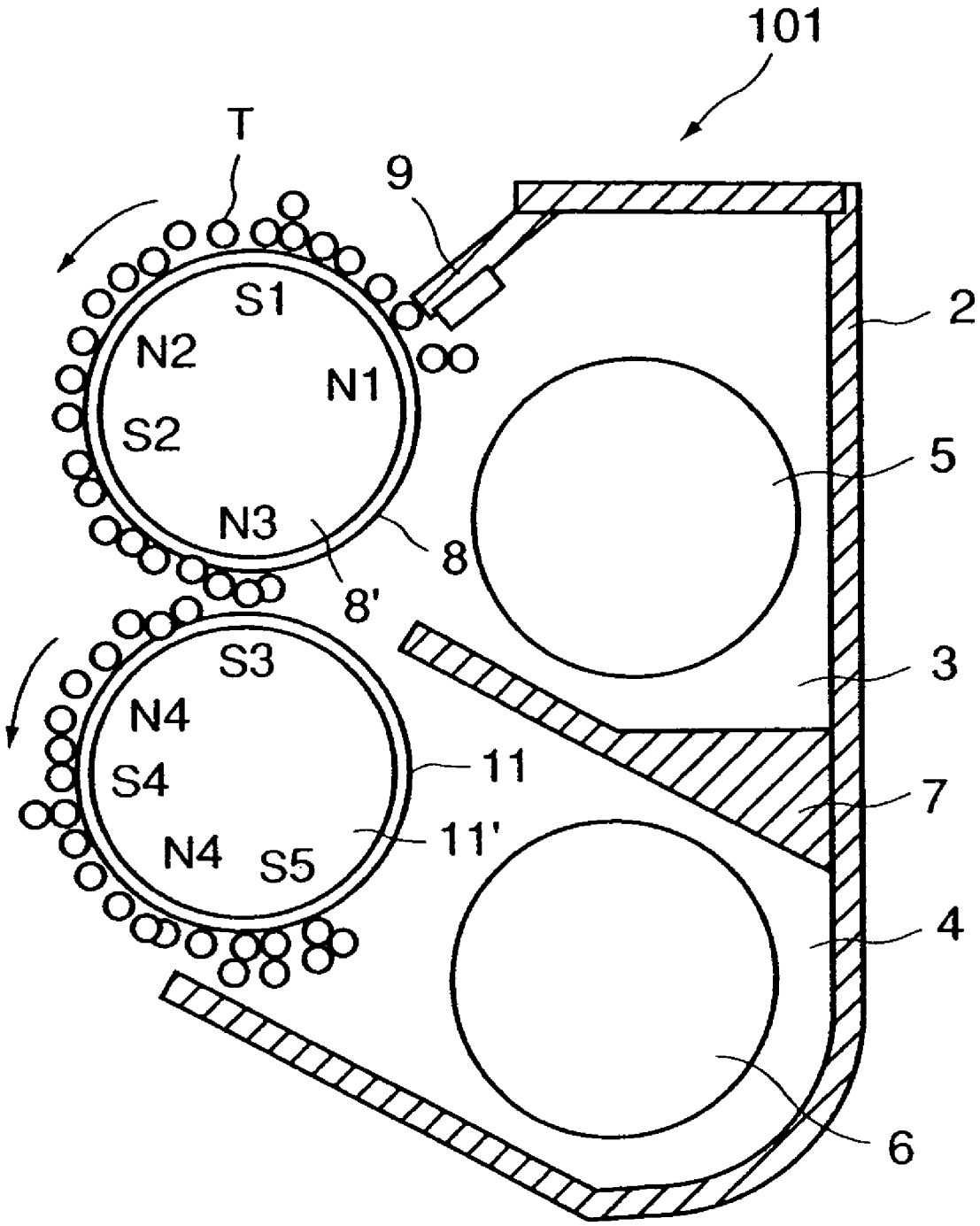
FIG. 11 is a sectional view of a developing device according to a further embodiment of the present invention.

Referring to FIG. 11, the description will be made as to a developing device according to Embodiment 6. FIG. 11 is a sectional view of the developing device 101.

Figure 12:
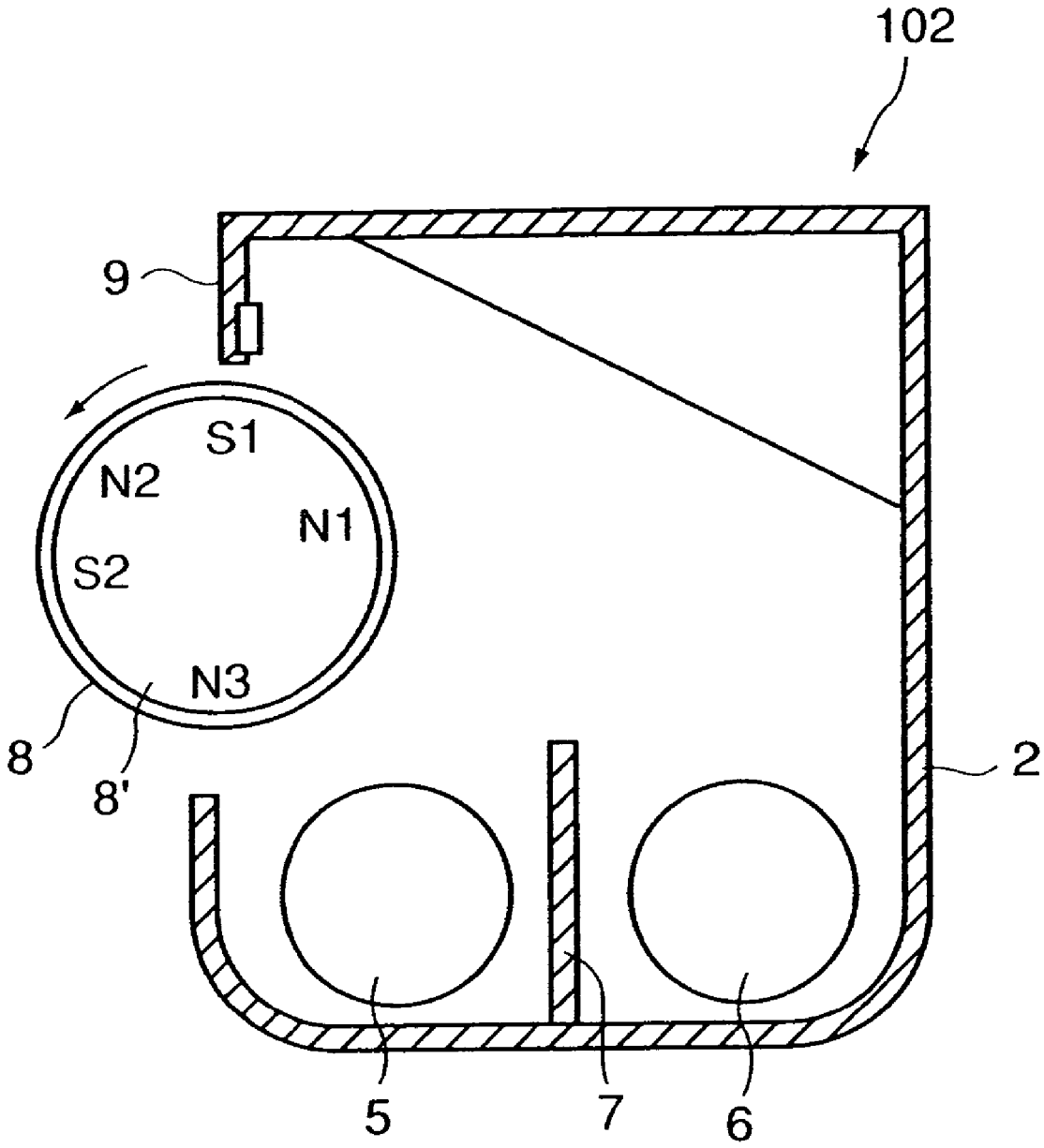
FIG. 12 is a sectional view of a conventional developing device.
Figure 13:
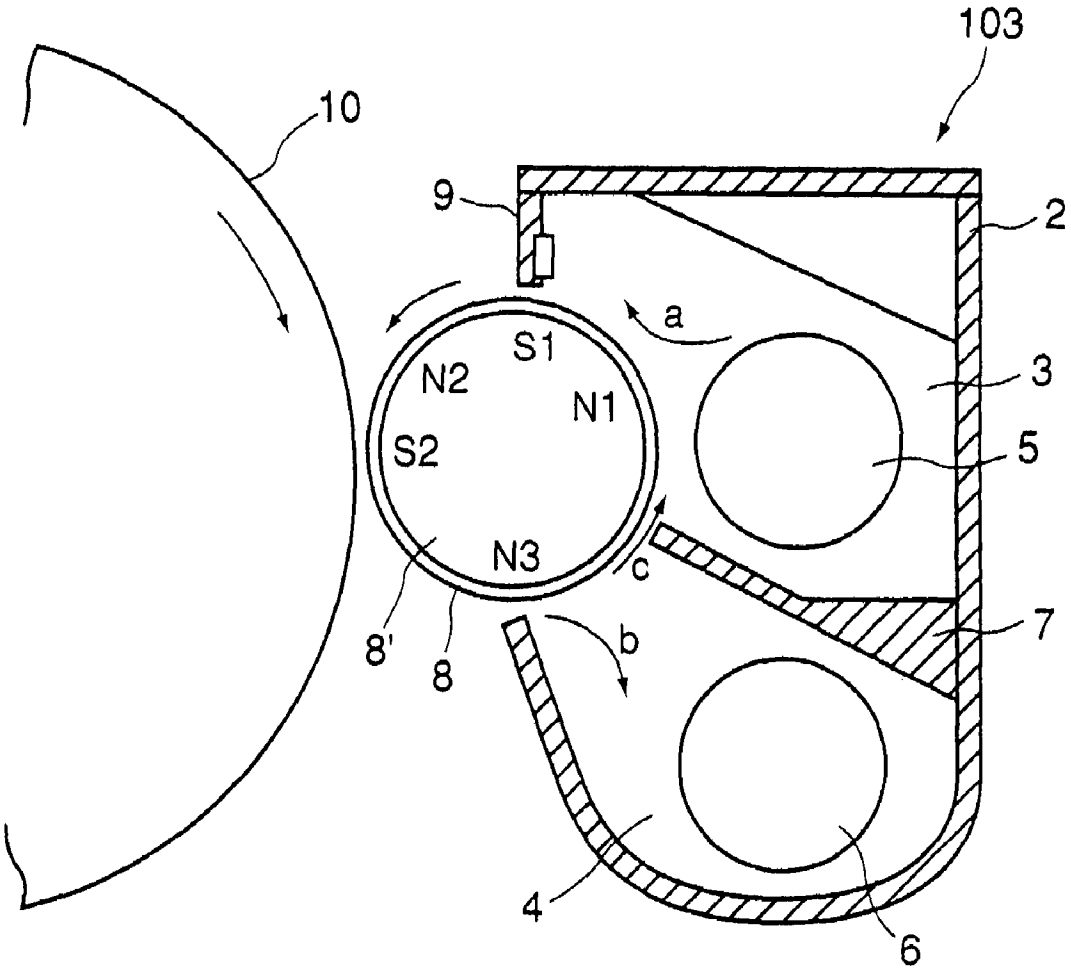
FIG. 13 is a sectional view of a conventional developing device.

In this embodiment is similar to Embodiment 5, but in this embodiment, a larger number of the magnetic poles of the magnet roller 11' in the feeding sleeve 11 (second developer carrying member) opposed to the photosensitive drum 10 are provided, more particularly 5 poles are provided (S4 pole is a second main developing pole in FIG. 12). In this arrangement, the distance between the adjacent magnetic poles can be reduced, and therefore, the feeding power is improved so that developer circulation stabilization is further improved.

Similarly to the developing devices 1, 100, 101 according to embodiments 4–6, the developer is supplied to the first developer carrying member in the developer chamber which takes a relatively upper position, and the developer is collected after being subjected to the developing action, into the stirring chamber which takes a relatively lower position.

The division of the developing container into the developer chamber and the stirring chamber is generally employed in developing devices using two component developer. However, Embodiments 1–3 are not limited to the developing devices using a two component developer bodies applicable to a developing device using a one component developer not containing carrier particles. In the case of using the one component developer, the present invention is used from the standpoint of the suppression of the deterioration of the developer attributable to the carryover of the developer particles.

As described in the foregoing, according to this embodiment, there is provided a developing device in which the circulating means for stirring, feeding and circulating in developer in the developing device are arranged substantially vertically, the deterioration of the developer can be easily prevented. In addition, the developer is prevented from being carried over on the developing sleeve. Thus, image defect peculiar to the light load developing device can be avoided. Deterioration.

As described in the foregoing, according to Embodiments 4–6, the circulating means for stirring, feeding and circulating the developer in the developing device are disposed substantially vertically, and the magnetic field generating means in the developer carrying member has a light load structure, wherein the polarity of developer caring members are employed by which the developer is prevented from being carried over on the developer caring member. Therefore, the image defect such as density non-uniformity or the like peculiar to the light load developing device can be avoided, and therefore, the deterioration of the developer can be suppressed, conveniently to the high-speed machines. Moreover, the development efficiency is improved by the second developer of caring member being opposed to the image bearing member.

While the invention has been described with reference to the structures disclosed herein, it is not confined to the details set forth and this application is intended to cover such modifications or changes as may come within the purpose of the improvements or the scope of the following claims.

What is claimed is:

1. A developing apparatus comprising:

a developer container for containing a developer comprising toner and a carrier, wherein an inside of said developer container is partitioned into a first chamber and a second chamber disposed above said first chamber with respect to a direction of gravity;

a first communicating portion and a second communicating portion for fluid communication between said first and second chambers disposed at opposite longitudinal ends of said first chamber and said second chamber;

a first developer carrying member, rotatably provided in said first chamber, for carrying the developer from said first chamber and for developing an electrostatic image formed on an image bearing member;

a second developer carrying member, rotatably provided in said second chamber adjacent to said first developer carrying member, for carrying the developer received from said first developer carrying member and for developing again the electrostatic image developed by said first developer carrying member;

a first feeding member, provided in said first chamber, for feeding the developer in a direction from said first communicating portion toward said second communicating portion, wherein the developer fed by said first feeding member is supplied into said second chamber through said second communicating portion; and a second feeding member, provided in said second chamber, for feeding the developer in a direction from said second communicating portion toward said first communicating portion, wherein the developer fed by said second feeding member is supplied into said first chamber through said first communicating portion.

2. An apparatus according to claim 1, further comprising a magnetic pole disposed at a position opposed to said second developer carrying member in said first developer carrying member, and a magnetic pole disposed at a position opposed to said first developer carrying member in said second developer carrying member.

3. An apparatus according to claim 1, further comprising a first magnetic pole and a second magnetic pole, disposed adjacent to each other in said first developer carrying member and which have the same magnetic polarity, wherein said second magnetic pole is disposed downstream of said first magnetic pole with respect to a rotational direction of said first developer carrying member, and a repelling magnetic field is formed between said first magnetic pole and said second magnetic pole.

4. An apparatus according to claim 3, further comprising a regulating member, disposed substantially opposed to said second magnetic pole, for regulating an amount of the developer carried on said first developer carrying member.

5. An apparatus according to claim 3, further comprising a third magnetic pole and a fourth magnetic pole, disposed adjacent to each other in said second developer carrying member and which have the same magnetic polarity, wherein said fourth magnetic pole is disposed downstream of said third magnetic pole with respect to a rotational direction of said second developer carrying member, and a repelling magnetic field is formed between said third magnetic pole and said fourth magnetic pole in said second chamber.

6. An apparatus according to claim 5, wherein said first magnetic pole and said fourth magnetic pole have polarities opposite to each other and are disposed opposed to each other.

7. A developing apparatus comprising:

a developing container for containing a magnetic developer, said developing container being partitioned into a first chamber and a second chamber constituting a circulation path of the developer;

a developing rotatable member, disposed in said first chamber and rotatable in a first rotational direction, for developing an electrostatic image formed on an image bearing member with the developer in said first chamber;

a feeding rotatable member, disposed adjacent to said developing rotatable member in said second chamber and rotatable in the first rotational direction, for feeding the developer magnetically removed from said developing rotatable member into said second chamber;

a first magnetic pole and a second magnetic pole, having the same magnetic polarity and being disposed adjacent to each other in said developing rotatable member in the listed order with respect to the first rotational direction of said developing rotatable member, for forming a repelling magnetic field;

a regulating member for regulating a layer thickness of the developer on said developing rotatable member, said regulating member being disposed at a position substantially opposed to said second magnetic pole; and a third magnetic pole and a fourth magnetic pole, having the same magnetic polarity and disposed adjacent to each other in said feeding rotatable member in the listed order with respect to the first rotational direction of said feeding rotatable member, for forming a repelling magnetic field, wherein said first magnetic pole and said fourth magnetic pole are substantially opposed to each other and have magnetic polarities that are different from each other.

8. An apparatus according to claim 7, wherein the developer is magnetically received from said developing rotatable member to said feeding rotatable member by a magnetic field formed between said first magnetic pole and said fourth magnetic pole.

9. An apparatus according to claim 7, wherein said first chamber and said second chamber are substantially vertically arranged.

10. An apparatus according to claim 9, wherein said first chamber is disposed substantially below said second chamber.

11. An apparatus according to claim 7, wherein the magnetic developer includes non-magnetic toner and a magnetic carrier.

12. An apparatus according to claim 7, wherein said feeding rotatable member is disposed adjacent to the image bearing member.

13. An apparatus according to claim 7, wherein said developing rotatable member and said feeding rotatable member are supplied with an AC-biased, DC voltage during a developing operation.

* * * * *

UNITED STATES PATENT AND TRADEMARK OFFICE

CERTIFICATE OF CORRECTION

PATENT NO. : 7,099,609 B2
APPLICATION NO. : 11/171541
DATED : August 29, 2006
INVENTOR(S) : Fumitake Hirobe et al.

It is certified that error appears in the above-identified patent and that said Letters Patent is hereby corrected as shown below:

COLUMN 1:
Line 58, “t” should read --the--.
Line 60, “t” should read --the--.
Line 65, “t” should read --the--.

COLUMN 2:
Line 25, “developer” should read --developer’s--.
Line 67, “these posed” should read --disposed--.

COLUMN 3:
Line 23, “corresponding” should read --correspond--.

COLUMN 4:
Line 49, “the use is made with” should read --use is made of--.
Line 53, “correspondingly” should read --corresponding--.
Line 63, “in” should read --been--.
Line 64, “These,” should read --This,--.
Line 67, “positioned” should read --position--.

COLUMN 5:
Line 6, “is” should read --are--.

COLUMN 7:
Line 44, “t” should read --the--.
Line 46, “t” should read --the--.
Line 53, “t” should read --the--.
Line 56, “t” should read --the--.

COLUMN 8:
Line 3, “t” should read --the--.
Line 20, “t” should read --the--.

COLUMN 9:
Line 26, “t” should read --the--.
Line 43, “beans” should read --means--.
Line 51, “The” should read --In the--.

UNITED STATES PATENT AND TRADEMARK OFFICE

CERTIFICATE OF CORRECTION

PATENT NO. : 7,099,609 B2
APPLICATION NO. : 11/171541
DATED : August 29, 2006
INVENTOR(S) : Fumitake Hirobe et al.

It is certified that error appears in the above-identified patent and that said Letters Patent is hereby corrected as shown below:

COLUMN 11:
Line 58, “into the first development carriage particularly” should read --onto the first developer carrying--.
Line 59, “stirring” should read --the stirring--.
Line 63, “a proposition” should read --upper position--.

COLUMN 13:
Line 15, “the-developer” should read --the developer--.
Line 29, “and” should read --end--.
Line 39, “other” should read --order--.
Line 58, “that” should read --that it--.
Line 64, “sense” should read --since--.

COLUMN 15:
Line 2, “form” should read --and form--.
Line 60, “as through” should read --passed through--.

COLUMN 17:
Line 43, “evening” should read --even in--.
Line 55, “in this” should read --This--.
Line 58, “are” should read --is--.

UNITED STATES PATENT AND TRADEMARK OFFICE

CERTIFICATE OF CORRECTION

PATENT NO. : 7,099,609 B2
APPLICATION NO. : 11/171541
DATED : August 29, 2006
INVENTOR(S) : Fumitake Hirobe et al.

It is certified that error appears in the above-identified patent and that said Letters Patent is hereby corrected as shown below:

COLUMN 18:
Line 22, "Deterioration" should be deleted.
Line 28, "polarity" should read --plurality--; and "caring" should read --carrying--.
Line 30, "caring" should read --carrying--.
Line 31, "defect" should read --defects--.
Line 36, "or caring" should read --of the carrying.--.

Signed and Sealed this

Eighth Day of April, 2008

JON W. DUDAS
*Director of the United States Patent and Trademark Office*